US008382422B2

(12) United States Patent
Guemmer

(10) Patent No.: US 8,382,422 B2
(45) Date of Patent: Feb. 26, 2013

(54) FLUID FLOW MACHINE

(75) Inventor: Volker Guemmer, Mahlow (DE)

(73) Assignee: Rolls-Royce Deutschland Ltd & Co KG (DE)

( * ) Notice: Subject to any disclaimer, the term of this patent is extended or adjusted under 35 U.S.C. 154(b) by 591 days.

(21) Appl. No.: 12/534,388

(22) Filed: Aug. 3, 2009

(65) Prior Publication Data

US 2010/0034637 A1 Feb. 11, 2010

(30) Foreign Application Priority Data

Aug. 8, 2008 (DE) ..... 10 2008 037 154

(51) Int. Cl.
*F01D 1/12* (2006.01)

(52) U.S. Cl. ..... 415/58.5; 415/914

(58) Field of Classification Search ..... 415/58.4, 415/58.5, 221, 914
See application file for complete search history.

(56) References Cited

U.S. PATENT DOCUMENTS

| | | | |
|---|---|---|---|
| 2,933,238 | A | 4/1960 | Stalker |
| 3,066,912 | A | 12/1962 | Scheper |
| 3,572,960 | A | 3/1971 | McBride |
| 3,694,102 | A | 9/1972 | Conrad |
| 3,846,038 | A | 11/1974 | Carriere et al. |
| 3,849,023 | A | 11/1974 | Klompas |
| 3,993,414 | A | 11/1976 | Meauze et al. |
| 4,155,680 | A | 5/1979 | Linko et al. |
| 4,415,310 | A | 11/1983 | Bouiller et al. |
| 4,466,772 | A | 8/1984 | Okapuu et al. |
| 4,479,755 | A | 10/1984 | Skoe |
| 4,642,027 | A | 2/1987 | Popp |
| 4,659,282 | A | 4/1987 | Popp |
| 5,059,093 | A | 10/1991 | Khalid et al. |
| 5,203,162 | A | 4/1993 | Burge |
| 5,230,605 | A | 7/1993 | Yamaguchi |
| 5,308,225 | A | 5/1994 | Koff et al. |

(Continued)

FOREIGN PATENT DOCUMENTS

| | | |
|---|---|---|
| DE | 889506 | 9/1953 |
| DE | 1042828 | 11/1958 |

(Continued)

OTHER PUBLICATIONS

Yang, Zhou, "Boundary Layer Separation Control on a Highly-Loaded, Low-Solidity Compressor Cascade" Journal of Thermal Science 19.2 (2010): 97-104.

(Continued)

*Primary Examiner* — Edward Look
*Assistant Examiner* — Liam McDowell
(74) *Attorney, Agent, or Firm* — Timothy J. Klima; Shuttleworth & Ingersoll, PLC

(57) ABSTRACT

A fluid flow machine has a main flow path 2 which is confined by a hub 3 and a casing 1 and in which at least one row of blades 5 is arranged. A gap 11 is provided on at least one blade row 5 between a blade end and a main flow path confinement, with the blade end and the main flow path confinement performing a rotary movement relative to each other. At least one reversing duct 7 is provided in the area of the blade leading edge in the main flow path confinement at a discrete circumferential position. The reversing duct 7 connects two openings 12, 13 arranged on the main flow path confinement.

29 Claims, 34 Drawing Sheets

U.S. PATENT DOCUMENTS

Figure 2A:
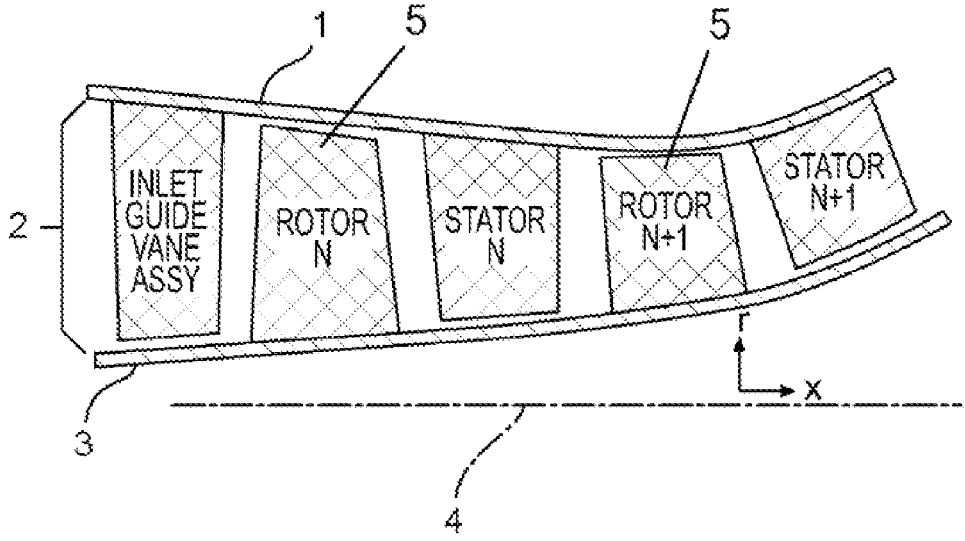
Figure 2B:
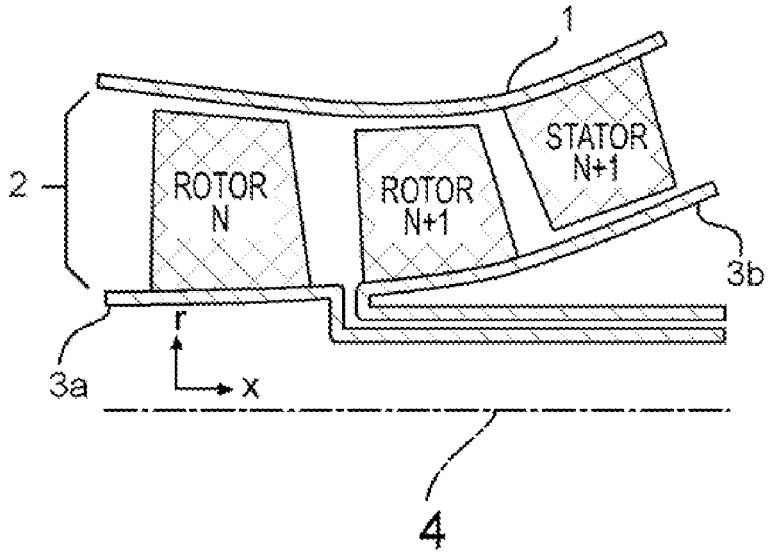
Figure 2C:
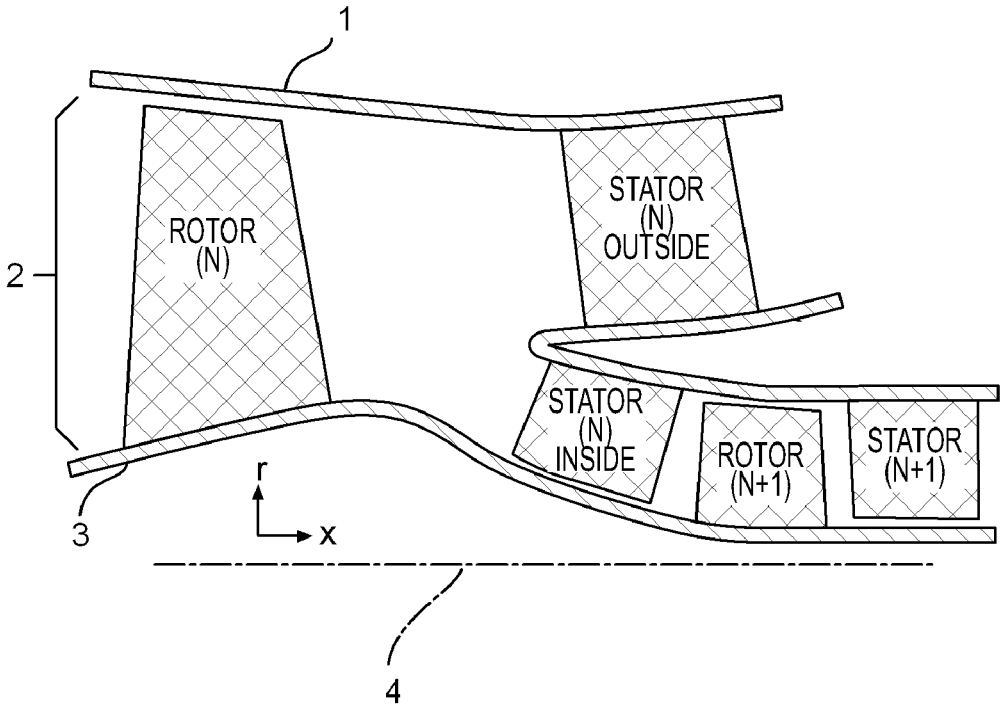
Figure 2D:
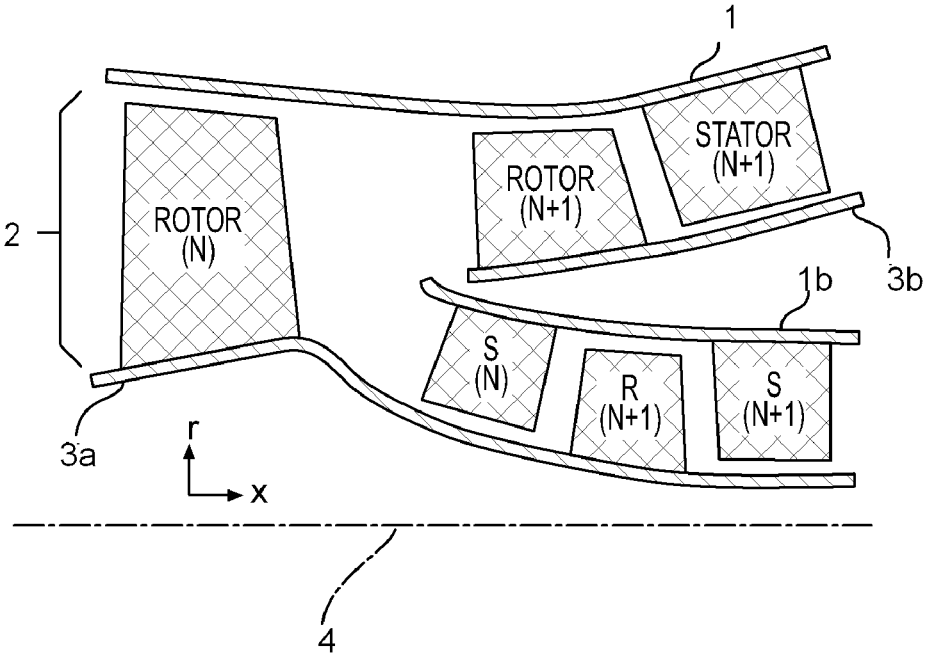

| | | | | |
|---|---|---|---|---|
| 5,327,716 | A | 7/1994 | Giffin et al. | |
| 5,431,533 | A | 7/1995 | Hobbs | |
| 5,474,417 | A * | 12/1995 | Privett et al. | 415/58.5 |
| 5,480,284 | A | 1/1996 | Wadia et al. | |
| 5,707,206 | A | 1/1998 | Goto et al. | |
| 5,762,034 | A | 6/1998 | Foss | |
| 5,762,470 | A | 6/1998 | Gelmedov et al. | |
| 5,876,182 | A | 3/1999 | Schulte | |
| 5,950,308 | A | 9/1999 | Koff et al. | |
| 6,109,868 | A | 8/2000 | Bulman et al. | |
| 6,234,747 | B1 * | 5/2001 | Mielke et al. | 415/119 |
| 6,290,458 | B1 * | 9/2001 | Irie et al. | 415/119 |
| 6,574,965 | B1 | 6/2003 | Feulner | |
| 6,585,479 | B2 * | 7/2003 | Torrance | 415/58.5 |
| 6,619,909 | B2 | 9/2003 | Barnett et al. | |
| 6,663,346 | B2 | 12/2003 | Munsell et al. | |
| 6,742,983 | B2 * | 6/2004 | Schmuecker | 415/1 |
| 6,832,890 | B2 | 12/2004 | Booth | |
| 7,077,623 | B2 | 7/2006 | Guemmer | |
| 7,097,414 | B2 | 8/2006 | Stangeland | |
| 7,186,072 | B2 * | 3/2007 | Seitz | 415/57.1 |
| 7,387,487 | B2 | 6/2008 | Guemmer | |
| 7,575,412 | B2 | 8/2009 | Seitz | |
| 7,594,793 | B2 | 9/2009 | Guemmer | |
| 7,645,121 | B2 | 1/2010 | Tudor | |
| 7,811,049 | B2 * | 10/2010 | Xu | 415/54.1 |
| 7,861,823 | B2 | 1/2011 | Prasad et al. | |
| 2003/0026695 | A1 | 2/2003 | Schmuecker | |
| 2004/0081552 | A1 | 4/2004 | Guemmer | |
| 2005/0019152 | A1 | 1/2005 | Seitz | |
| 2005/0058541 | A1 | 3/2005 | LeBiez et al. | |
| 2005/0226717 | A1 | 10/2005 | Xu | |
| 2005/0238483 | A1 | 10/2005 | Guemmer | |
| 2006/0051199 | A1 | 3/2006 | Guemmer | |
| 2006/0104805 | A1 | 5/2006 | Guemmer | |
| 2006/0153673 | A1 | 7/2006 | Guemmer | |
| 2008/0044273 | A1 * | 2/2008 | Khalid | 415/57.4 |
| 2008/0199306 | A1 | 8/2008 | Lebret | |
| 2009/0160135 | A1 | 6/2009 | Turini et al. | |
| 2009/0290974 | A1 * | 11/2009 | Bayere et al. | 415/58.5 |

FOREIGN PATENT DOCUMENTS

| | | |
|---|---|---|
| DE | 1428188 | 11/1968 |
| DE | 3407945 | 9/1985 |
| DE | 19632207 | 2/1998 |
| DE | 10135003 | 10/2002 |
| DE | 10233032 | 1/2004 |
| DE | 10330084 | 3/2004 |
| DE | 102004043036 | 3/2006 |
| EP | 0497574 | 9/1995 |
| EP | 0718469 | 6/1996 |
| EP | 0754864 | 1/1997 |
| EP | 0719908 | 3/2000 |
| EP | 1013937 | 6/2000 |
| EP | 1286022 | 2/2003 |
| EP | 1382855 | 1/2004 |
| GB | 619722 | 3/1949 |
| GB | 987625 | 3/1965 |
| GB | 2408546 | 6/2005 |
| WO | 9510692 | 4/1995 |

OTHER PUBLICATIONS

Strazisar, A.J., Bright, M.B., Thorp, S., Culley, D.E., Suder, K.L., "Compressor Stall Control Through Endwall Recirculation", ASME GT2004-54295, proceedings of the ASME Turbo Expo 2004, Jun. 14-17, 2005, Vienna, Austria.

Gao, P., Zhang, Y., Zhang, S., "Numerical Investigation of the Different Casing Treatment in a Centrifugal Compressor", Proceeding APWCS '10 Proceedings of the 2010 Asia-Pacific Conference on Wearable Computing Systems.

Moore, R., Effect of Casing Treatment on Overall and Blade-Element Performance of a Compressor Rotor, NASA TN D-6538, Nov. 1971.

Jian H., Hu, W., "Numerical Investigation of Inlet Distortion on an Axial Flow Compressor Rotor with Circumferential Groove Casing Treatment", Chinese Journal of Aeronautics, 21 (2008) 496-505.

Friedrichs, Jens, Sven Baumgarten, Gunter Kosyna and Udo Stark, "Effect of Stator Design on Stator Boundary Layer Flow in a Highly Loaded Single-Stage Axial Flow Low-Speed Compressor", Journal of Turbomachinery 123.3 (2001): 483.

German Search Report dated Jun. 8, 2011 from a related application [568].

German Search Report Dated Jul. 1, 2011 from related patent application [596].

European Search Report dated Nov. 22, 2006 from related patent application [472].

German Search Report dated Apr. 27, 2012 from counterpart German patent application.

Guemmer—U.S. Appl. No. 12/222,532, filed Aug. 11, 2008.

Johann—U.S. Appl. No. 12/379,788, filed Feb. 27, 2009.

Guemmer—U.S. Appl. No. 12/498,050, filed Jul. 6, 2009.

Guemmer—U.S. Appl. No. 11/280,817, filed Nov. 17, 2005.

* cited by examiner

Fig.1a: State of the art
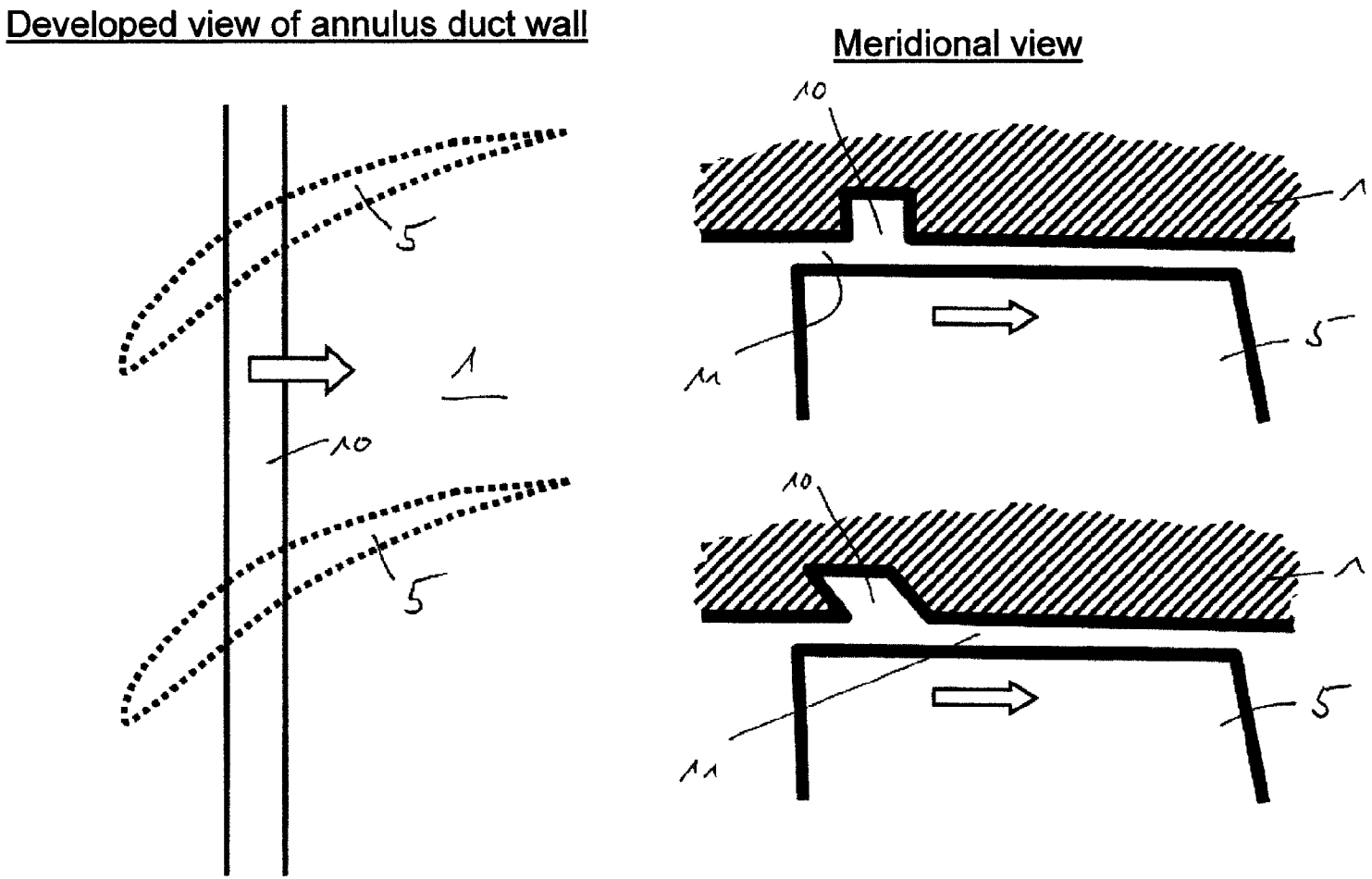

Fig. 1b: State of the art
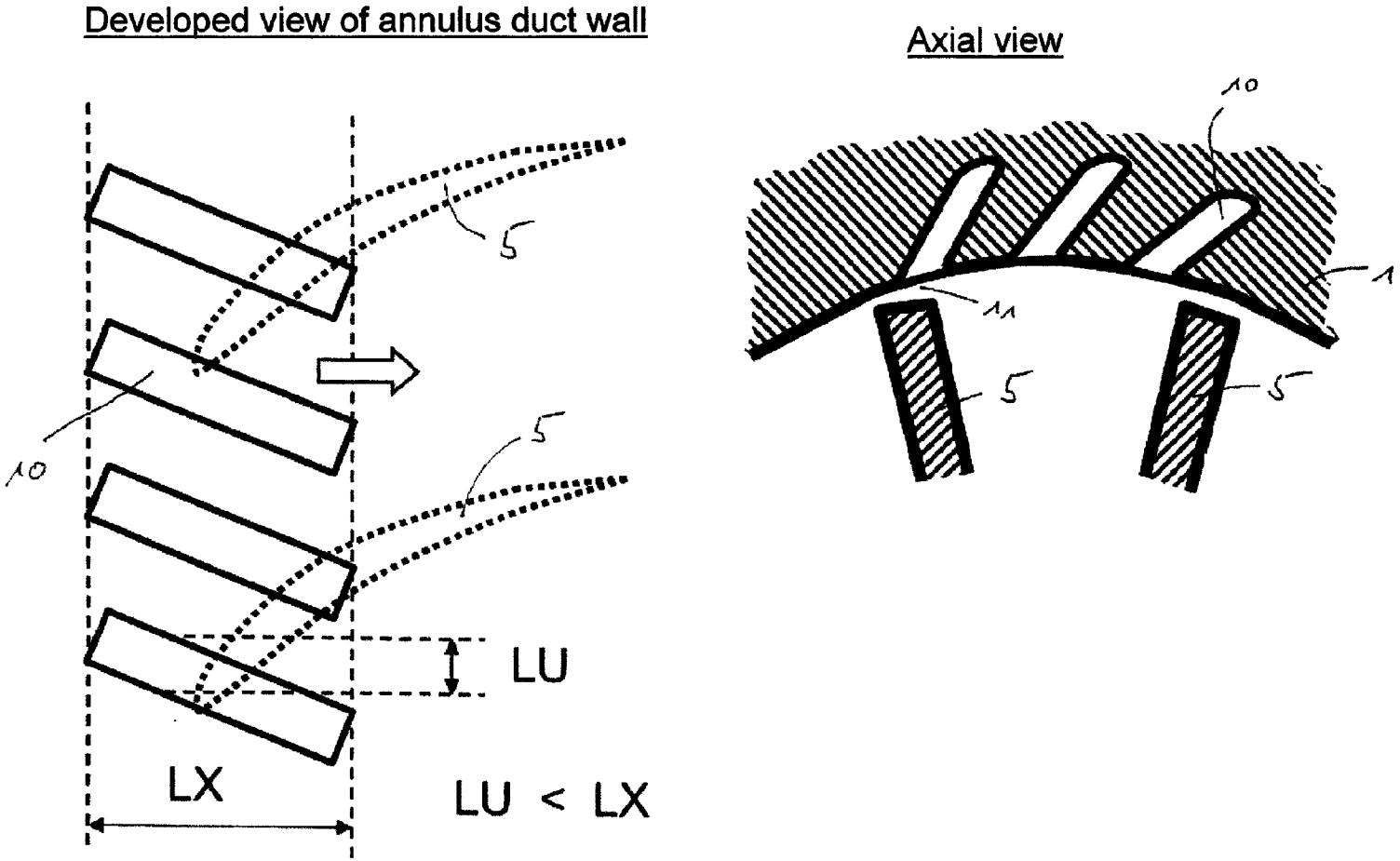

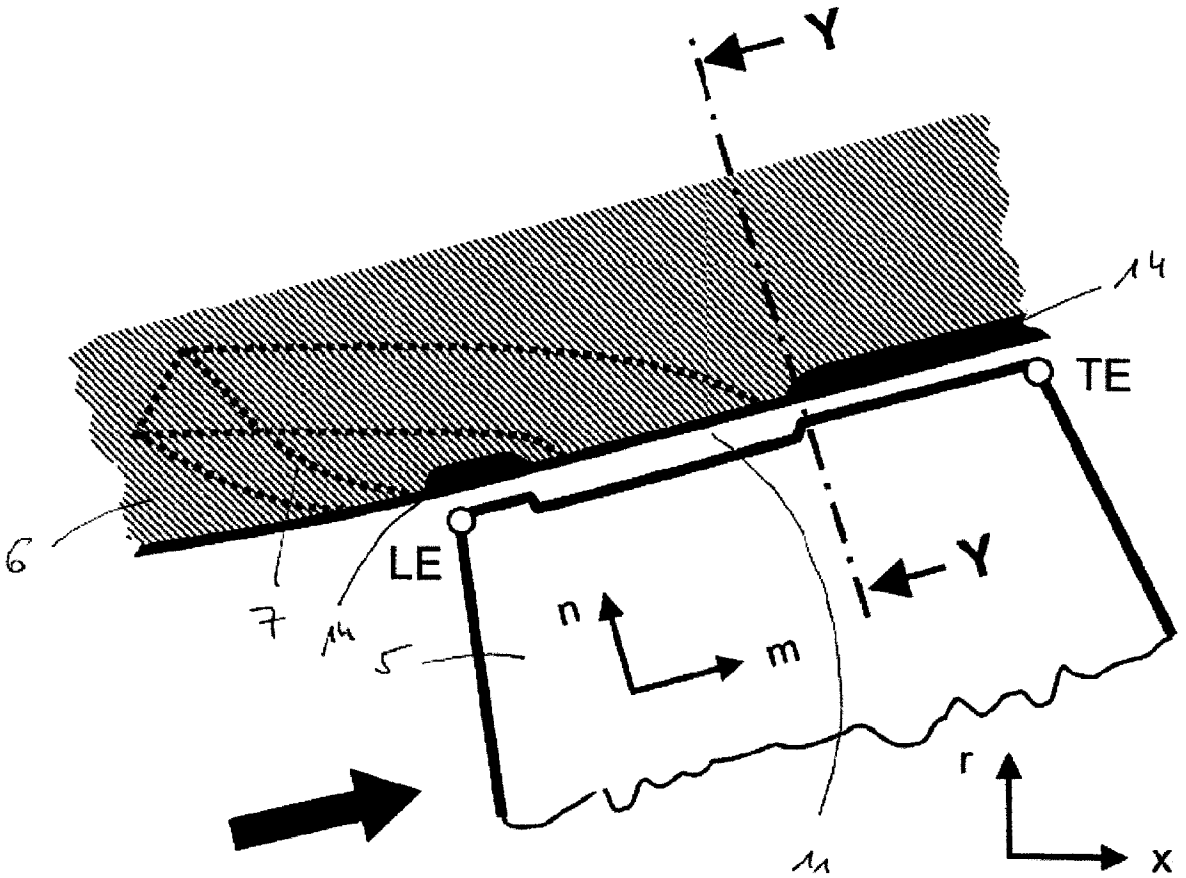
Y
Y
TE
LE
14
14
14

FLUID FLOW MACHINE

This application claims priority to German Patent Application 10 2008 037 154.8 filed Aug. 8, 2008, the entirety of which is incorporated by reference herein.

This invention relates to a fluid flow machine with reversing.

The aerodynamic loadability and the efficiency of fluid flow machines such as blowers, compressors, pumps and fans, is limited in particular by the growth and the separation of boundary layers in the rotor and stator blade tip area near the casing or the hub wall, respectively. On blade rows with running gap, this leads to re-flow phenomena and the occurrence of operational instability of the machine at higher loads.

Fluid flow machines according to the state of the art either have no particular features to provide remedy in this area, or so-called casing treatments are used as counter-measure.

The simplest form of casing treatments are circumferential grooves with rectangular or parallelogrammic cross-section, as disclosed for example in EP 0 754 864 A1 and shown in FIG. 1*a* by way of an exemplary sketch.

Other solutions provide rows of slots or apertures in the casing, with the individual slots/apertures being essentially oriented in the flow direction and having a slender form with a small extension as viewed in the circumferential direction of the machine, this being disclosed for example in DE 101 35 003 C1 and shown in FIG. 1*b* by way of a sketch.

Other casing treatments include reversing ducts, which are provided as rings on the entire circumference in the area of a rotor in the casing, with stator vanes being often used to reduce the flow swirl within the casing treatment, as for example in EP 0 497 574 A1, US 2005-0226717 A1, U.S. Pat. No. 6,585,479 B2, US 2005-0226717 A1 and DE 103 30 084 A1.

Existing concepts of casing treatments in the form of slots and/or chambers in the annulus duct wall provide for an increase in stability of the fluid flow machine. However, due to unfavorably selected arrangement and shaping, this increase in stability is unavoidably accompanied by a loss in efficiency. The presently known solutions furthermore consume much space at the periphery of the annulus duct of the fluid flow machine and, due their shape (e.g. simple, parallelogrammic circumferential casing grooves), have only limited efficiency and are restricted to an arrangement in the casing in the area of a rotor blade row.

A broad aspect of the present invention is to provide a fluid flow machine of the type specified at the beginning above which, while avoiding the disadvantages of the state of the art, is characterized by exerting a highly effective influence on the boundary layer in the blade tip area.

More particularly, the present invention relates to a portion of the annulus duct of a fluid flow machine in the area of a blade row with free end and running gap, in which a number of reversing ducts distributed in the circumferential direction is provided, which, characterized by spatial compactness and aerodynamic design, return the fluid to a further upstream position. The concept pertains to arrangements with running gap and relative movement between blade end and main flow path confinement, both on the casing and on the hub.

The present invention therefore relates to fluid flow machines, such as blowers, compressors, pumps and fans of the axial, semi-axial and radial type. The working medium or fluid may be gaseous or liquid.

The fluid flow machine may include one or several stages, each having a rotor and a stator, in individual cases, the stage is formed by a rotor only.

The rotor includes a number of blades, which are connected to the rotating shaft of the machine and impart energy to the working medium. The rotor may be designed with or without shroud at the outward blade ends.

The stator includes a number of stationary vanes, which may either feature a fixed or a free blade end on the hub and on the casing side.

Rotor drum and blading are usually enclosed by a casing, in other cases (e.g. aircraft or ship propellers) no such casing exists.

The machine may also feature a stator, a so-called inlet guide vane assembly, upstream of the first rotor. Departing from the stationary fixation, at least one stator or inlet guide vane assembly may be rotatably borne, to change the angle of attack. Variation is accomplished for example via a spindle accessible from the outside of the annulus duct.

In a special configuration the fluid flow machine may have at least one row of variable rotors.

In an alternative configuration, multi-stage types of fluid flow machines according to the present invention may have two counter-rotating shafts, with the direction of rotation of the rotor blade rows alternating between stages. Here, no stators exist between subsequent rotors.

Finally, the fluid flow machine may—alternatively—feature a bypass configuration such that the single-flow annulus duct divides into two concentric annuli behind a certain blade row, with each of these annuli housing at least one further blade row.

FIG. 2 shows examples of fluid flow machines relevant to the present invention.

Figure 3A:
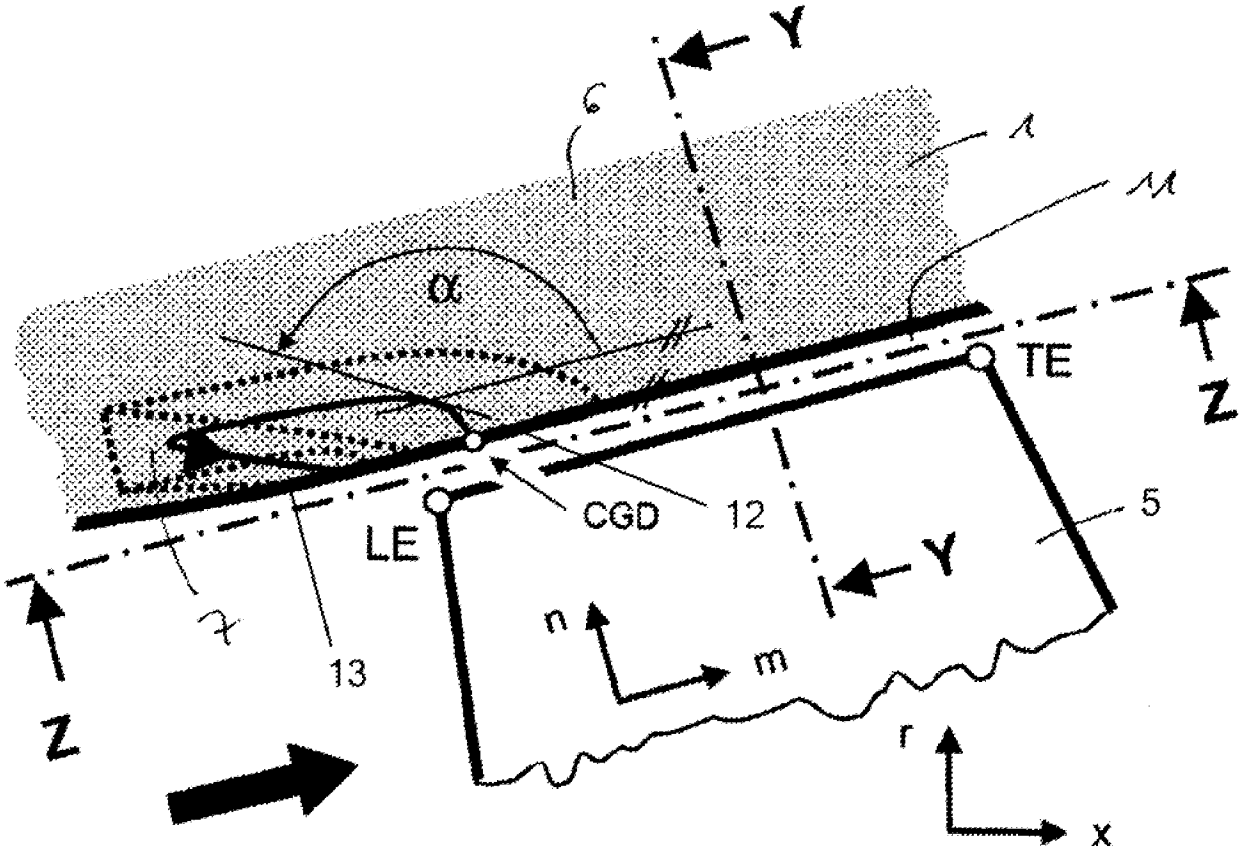
Figure 3B:
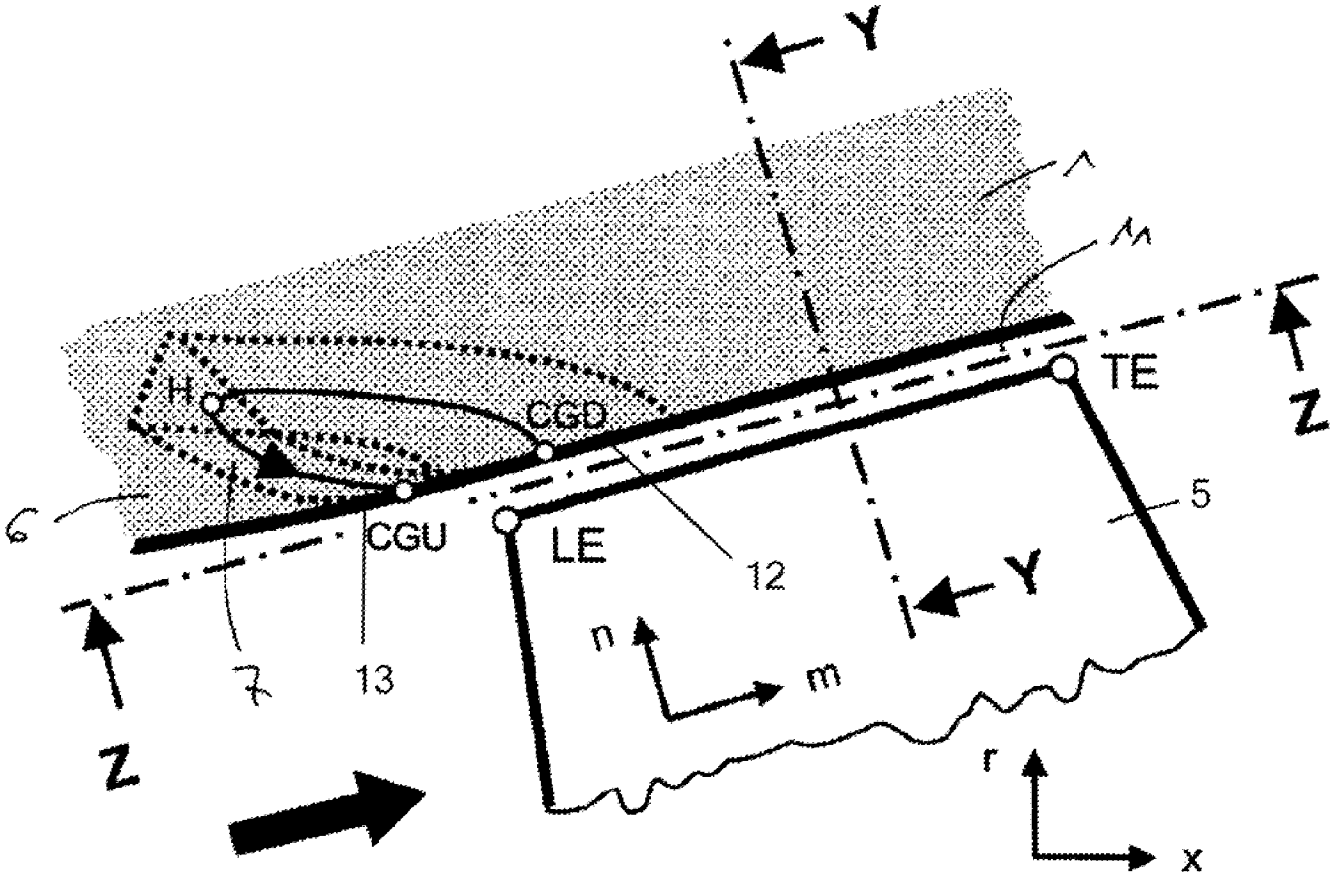
Figure 3C:
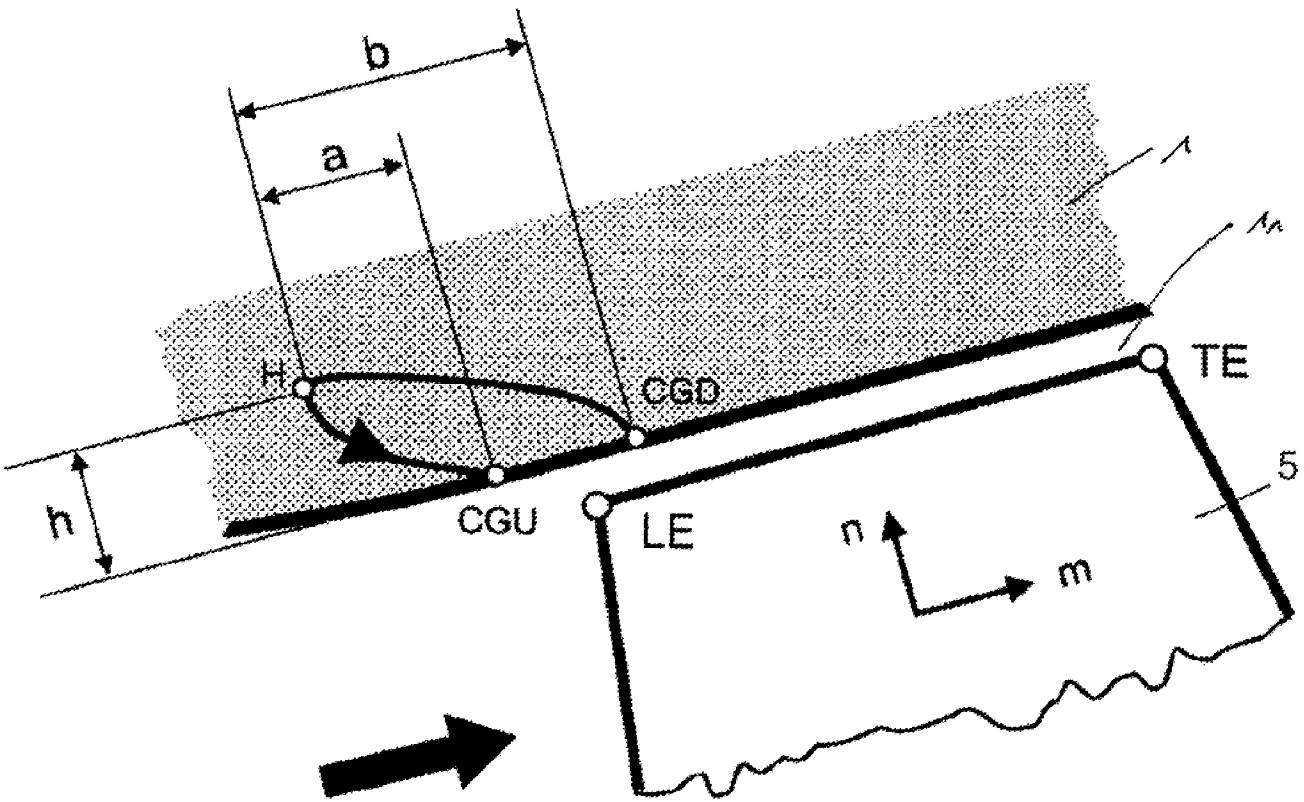
Figure 3D:
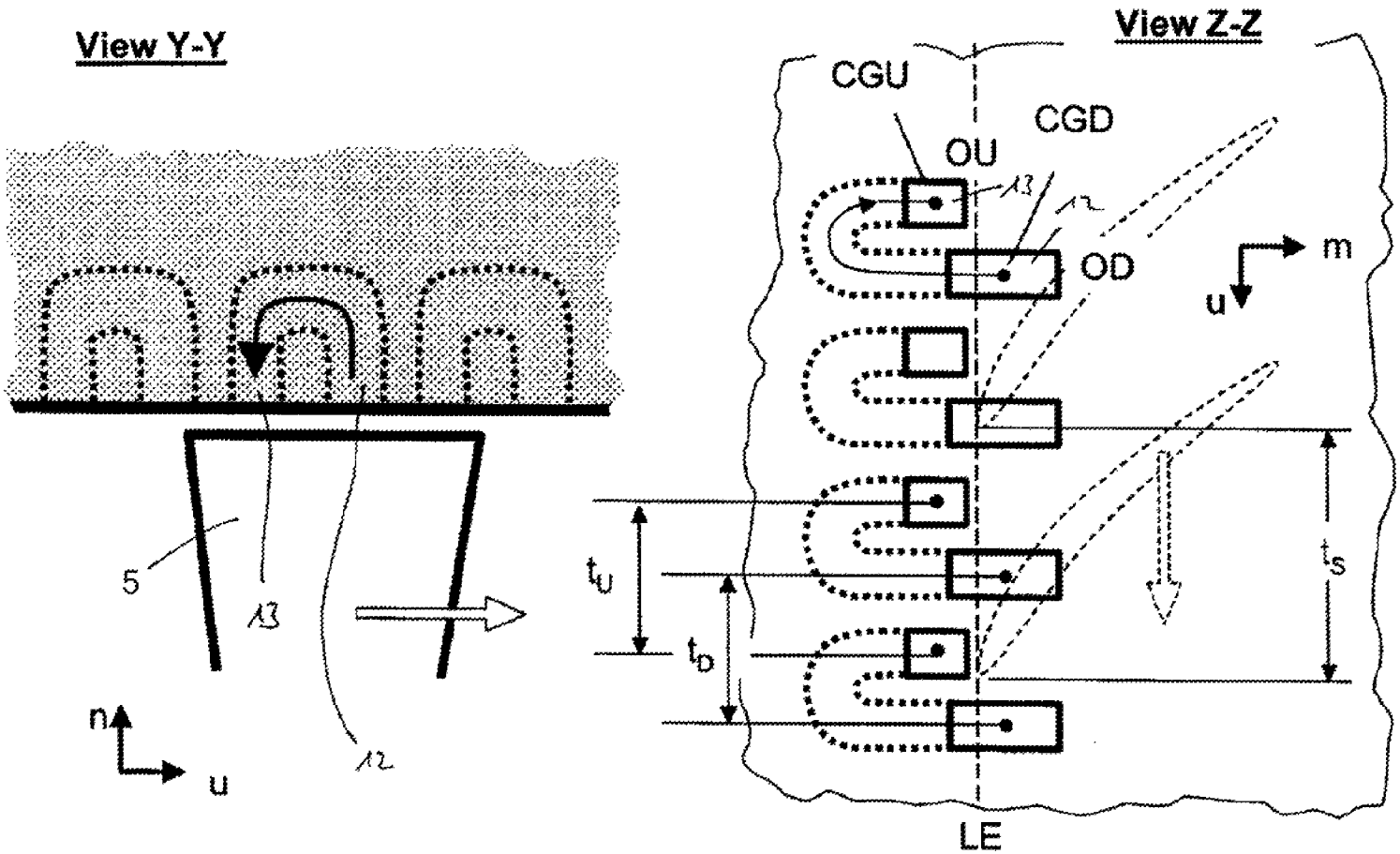
Figure 3E:
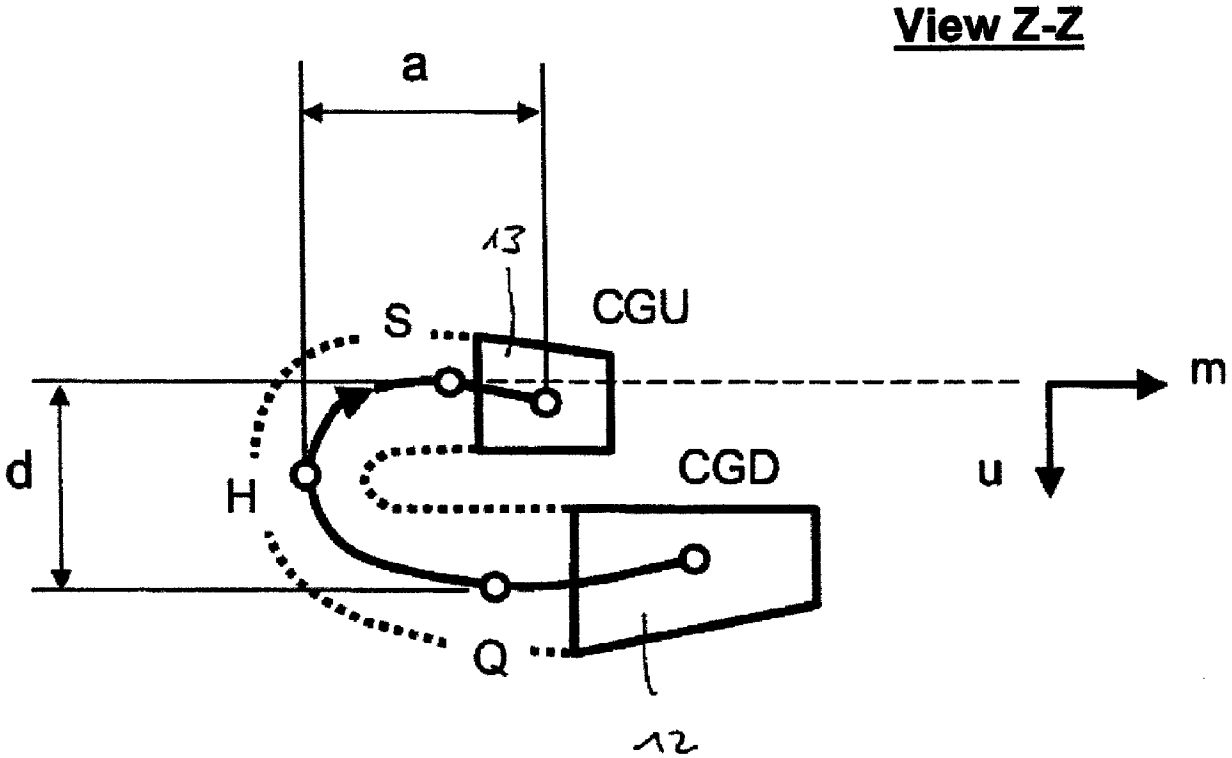
Figure 3F:
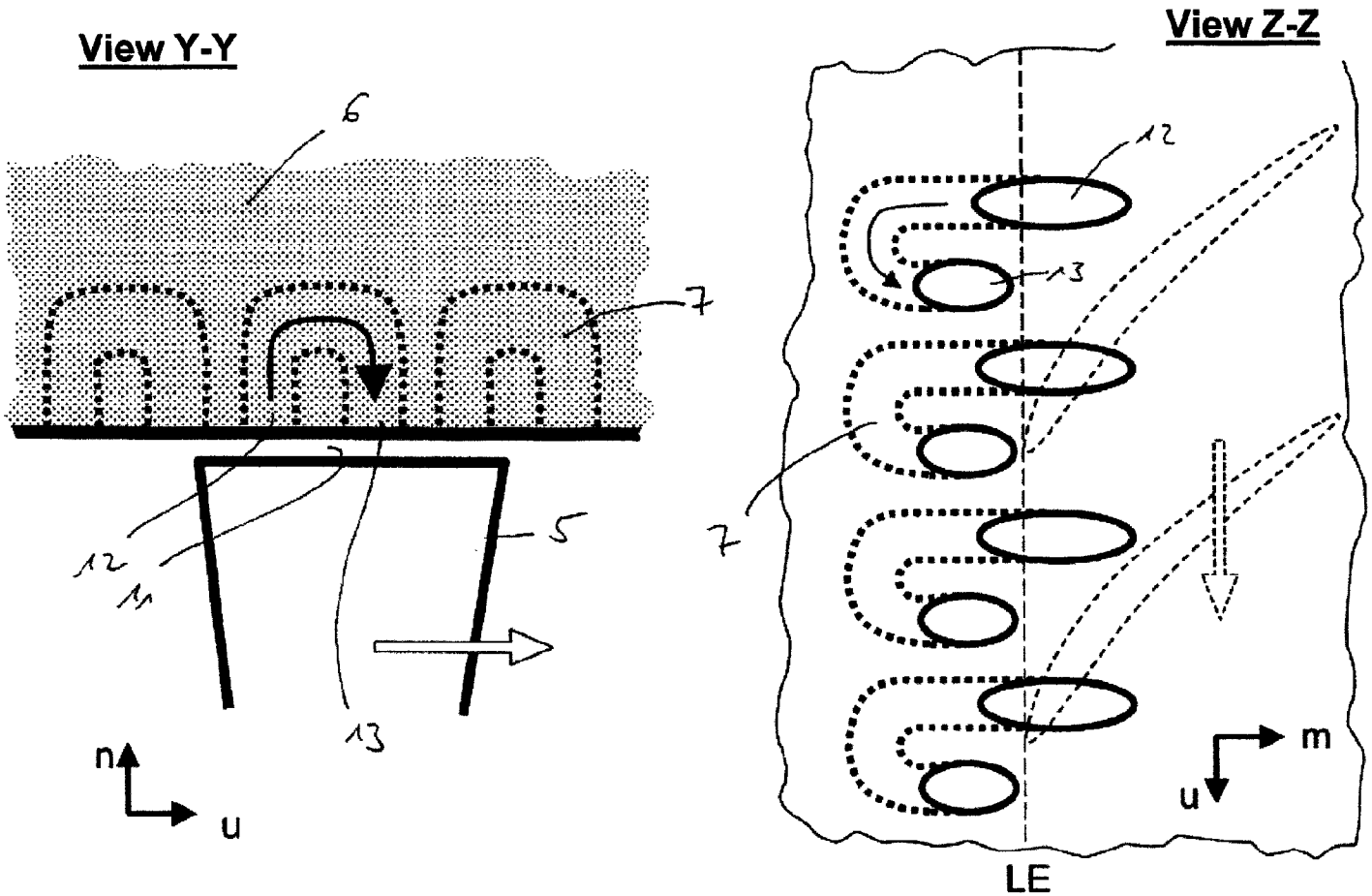
Figure 3G:
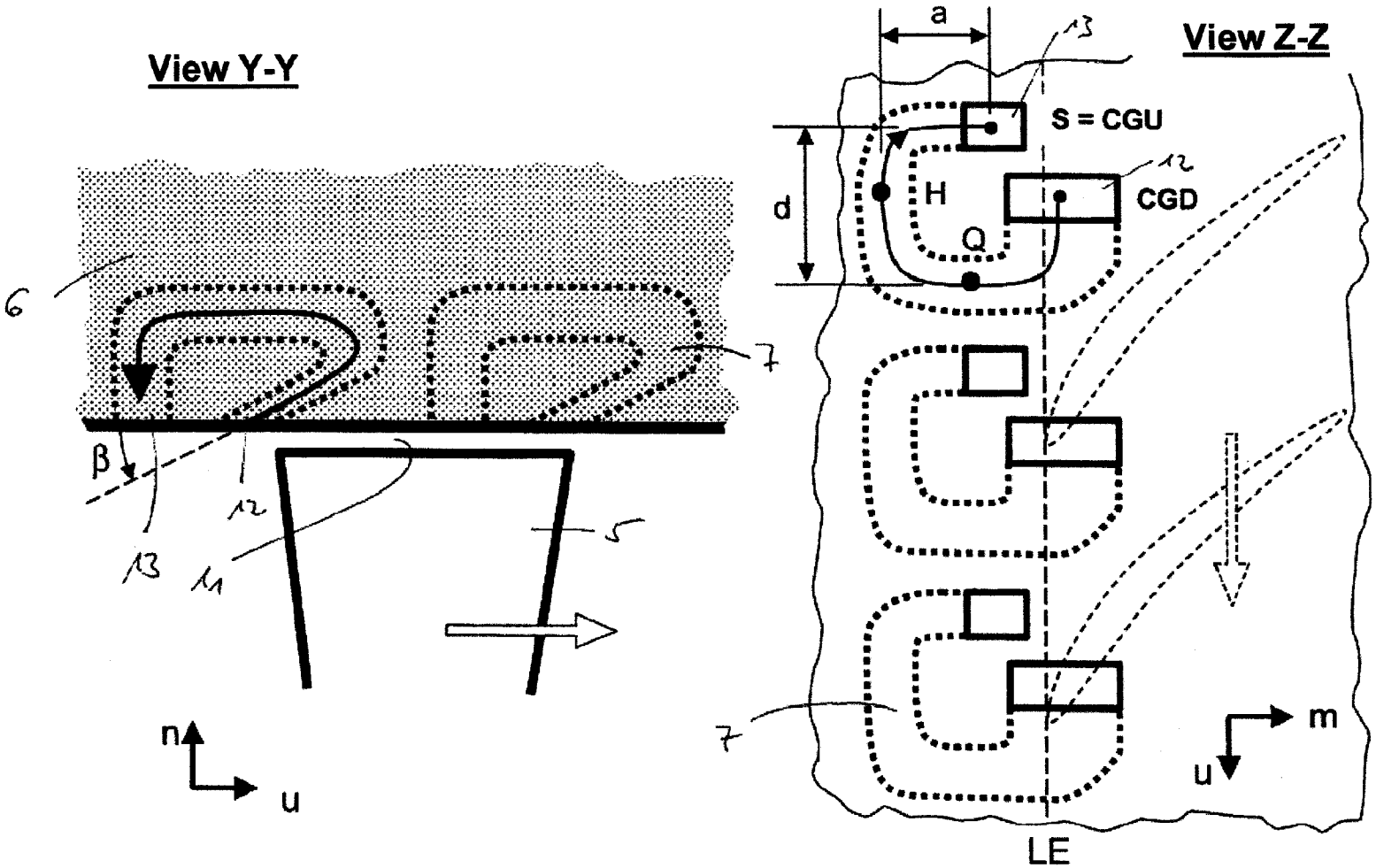
Figure 3H:
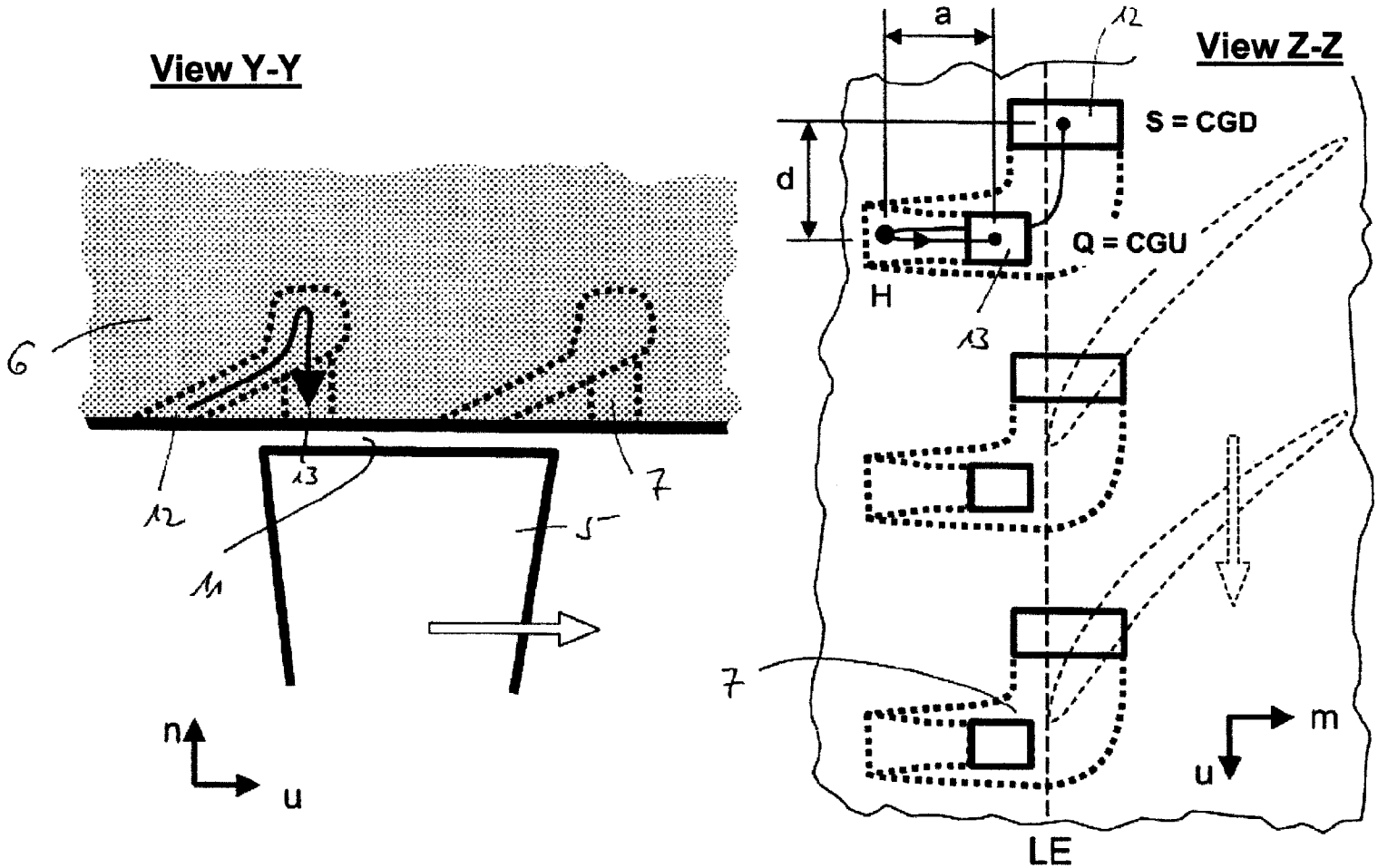
Figure 3I:
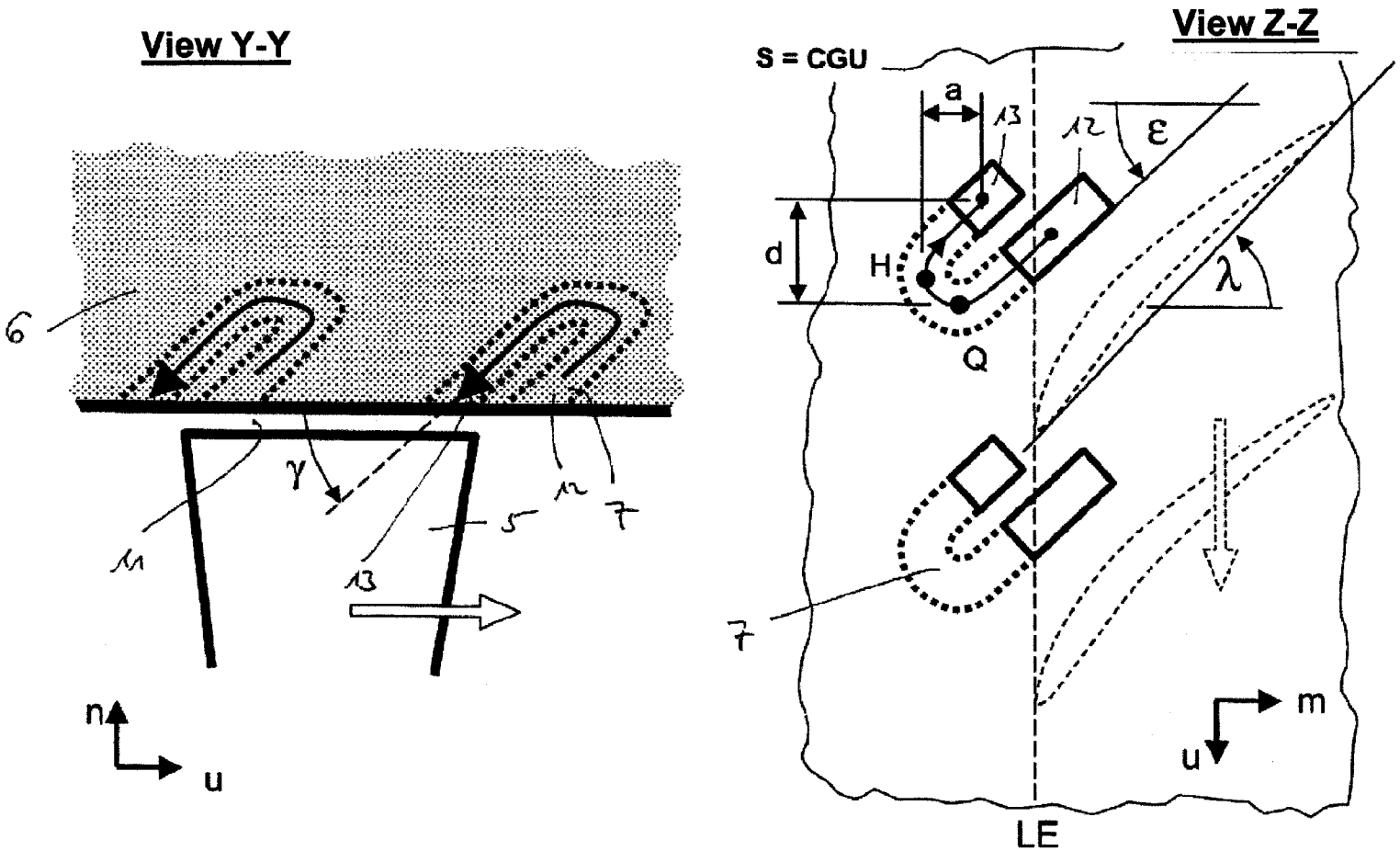
Figure 3J:
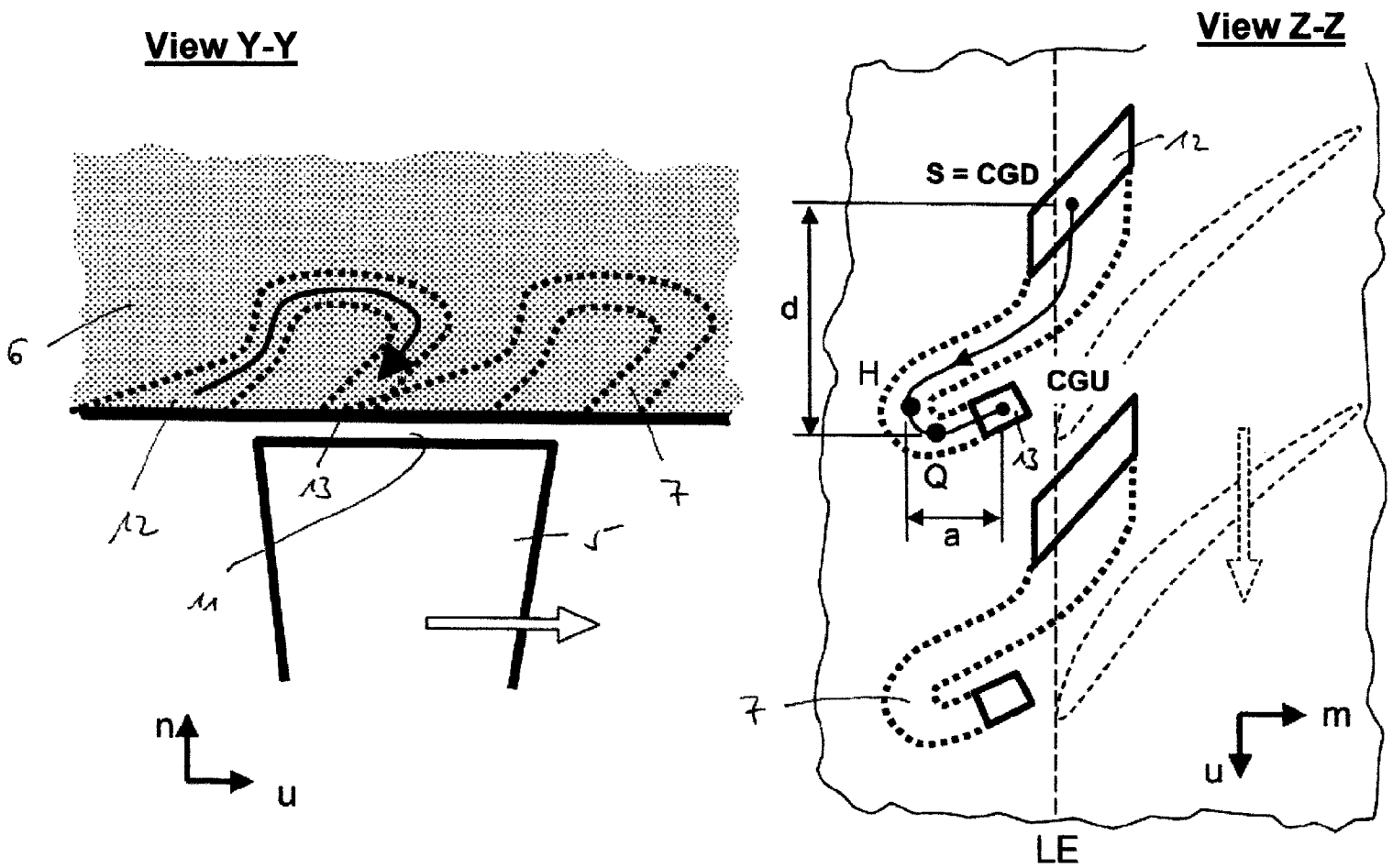
Figure 3K:
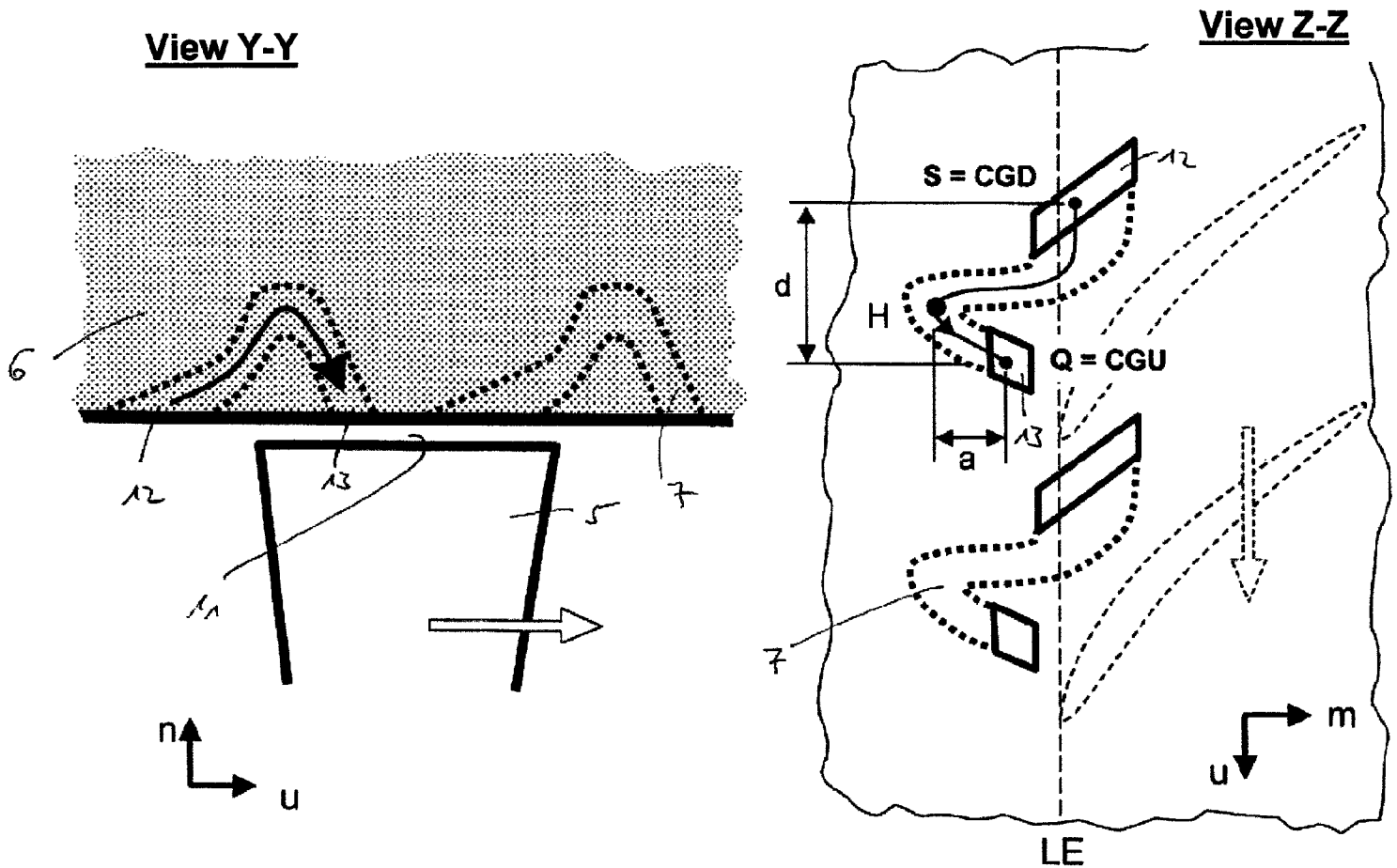
Figure 3I:
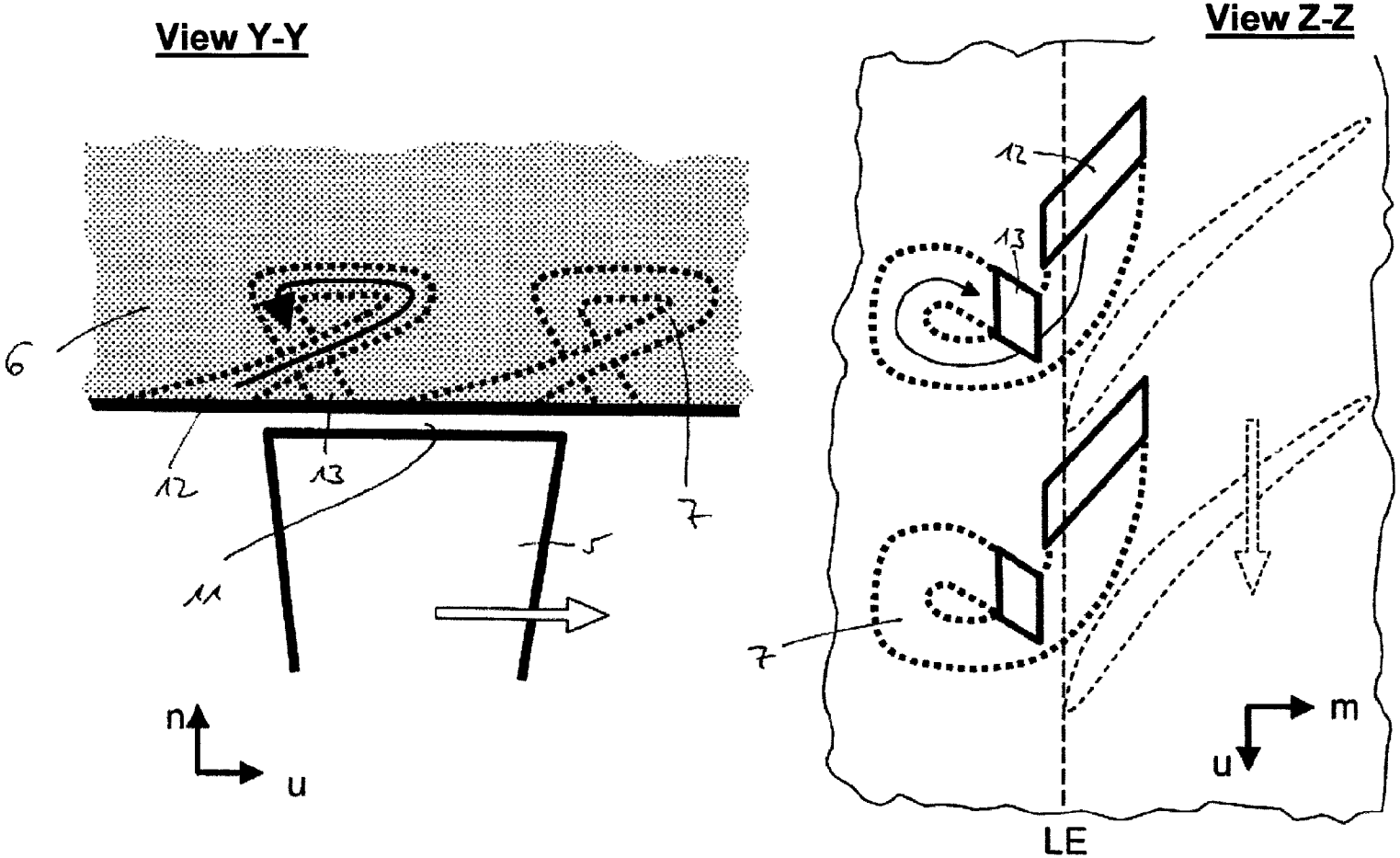
Figure 3M:
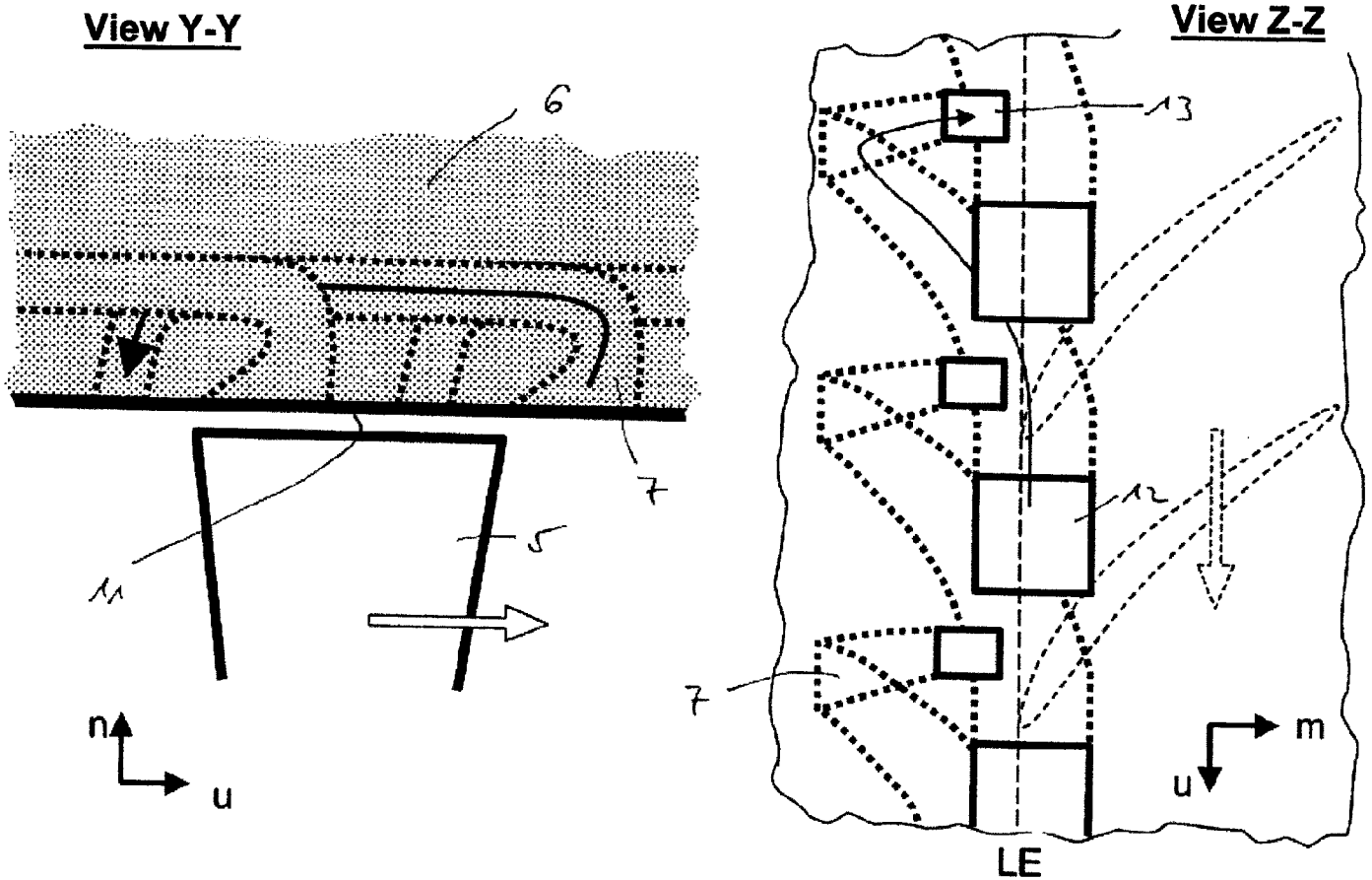
Figure 3N:
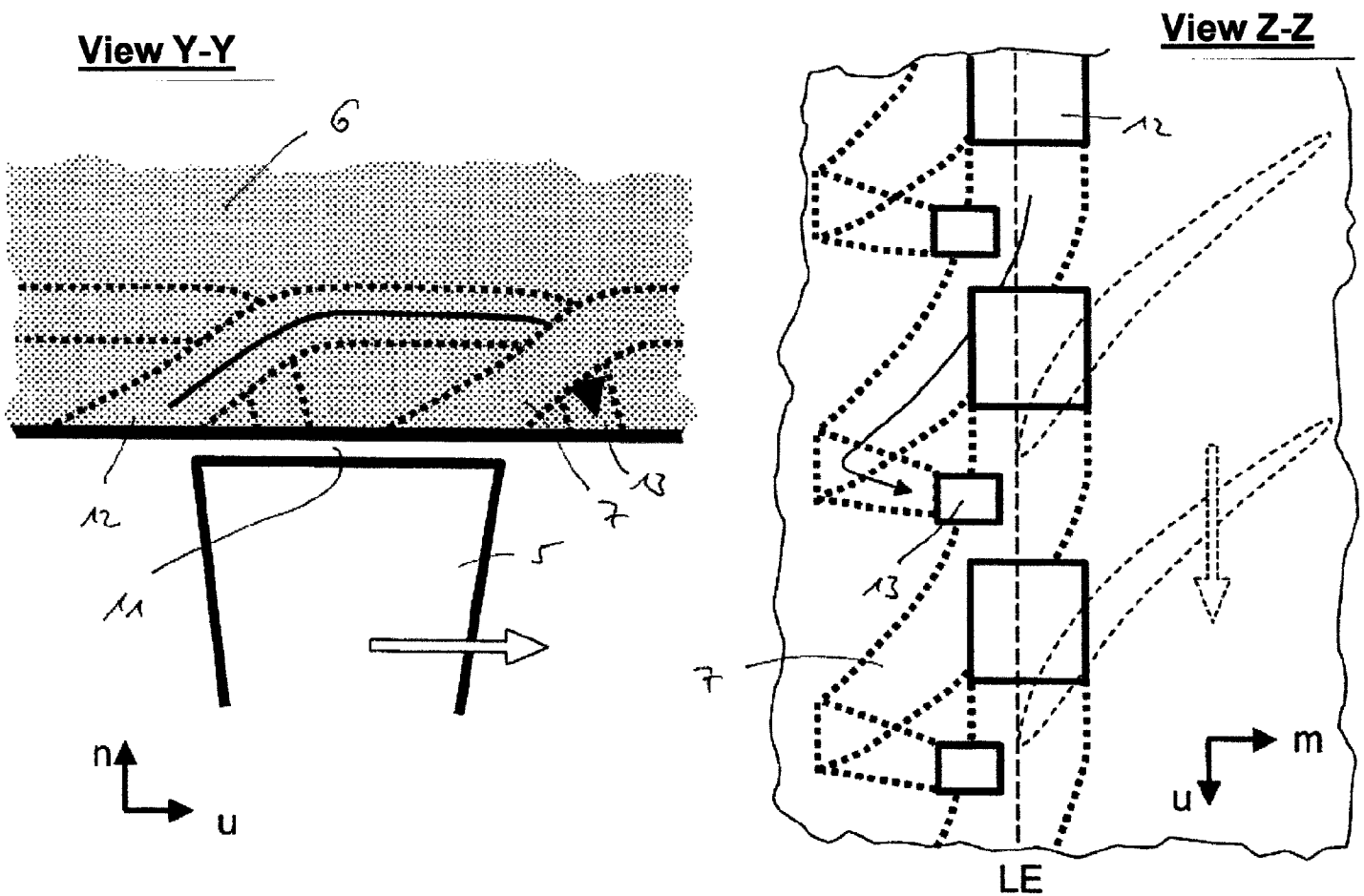
Figure 4A:
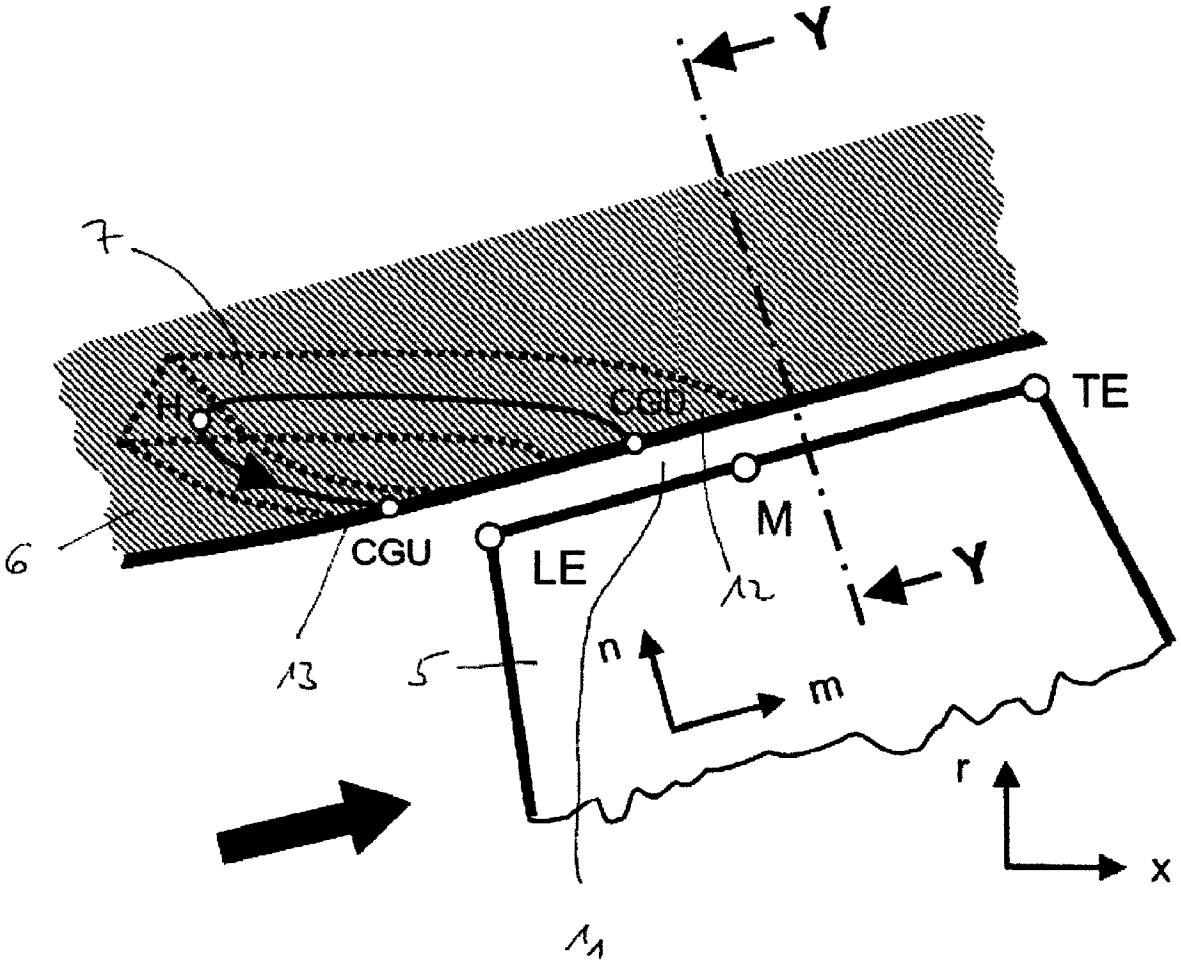
Figure 4B:
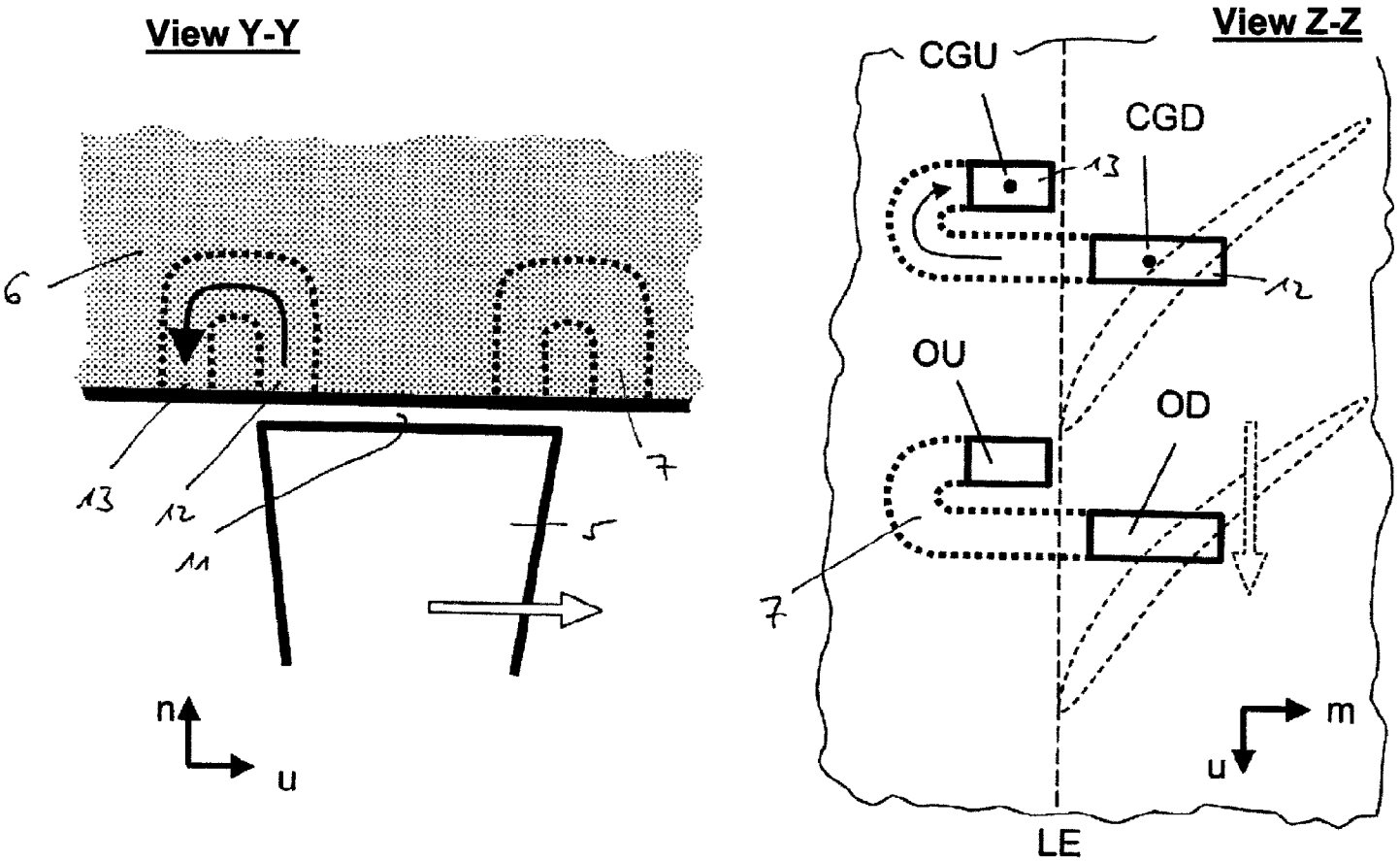
Figure 4C:
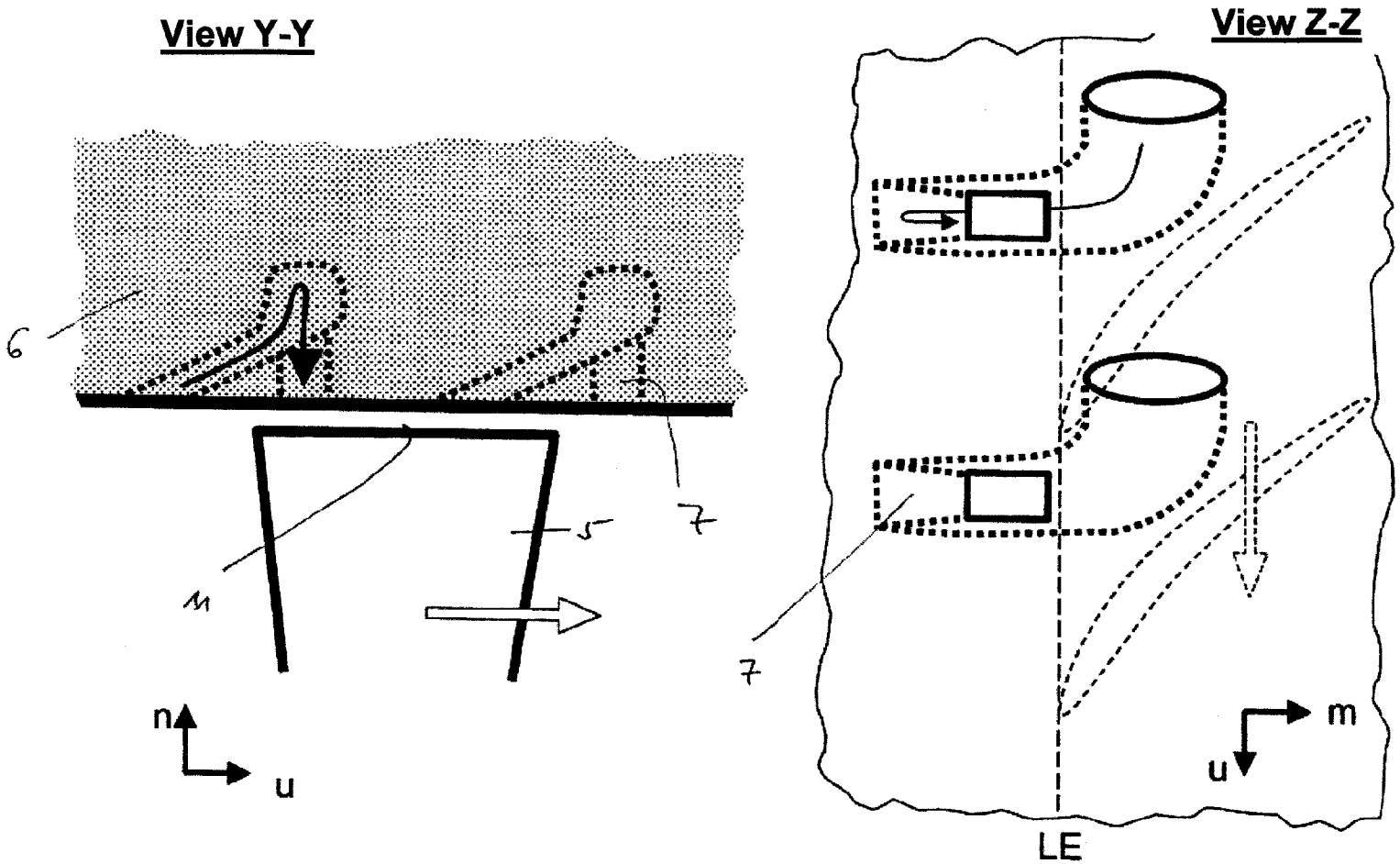
Figure 4D:
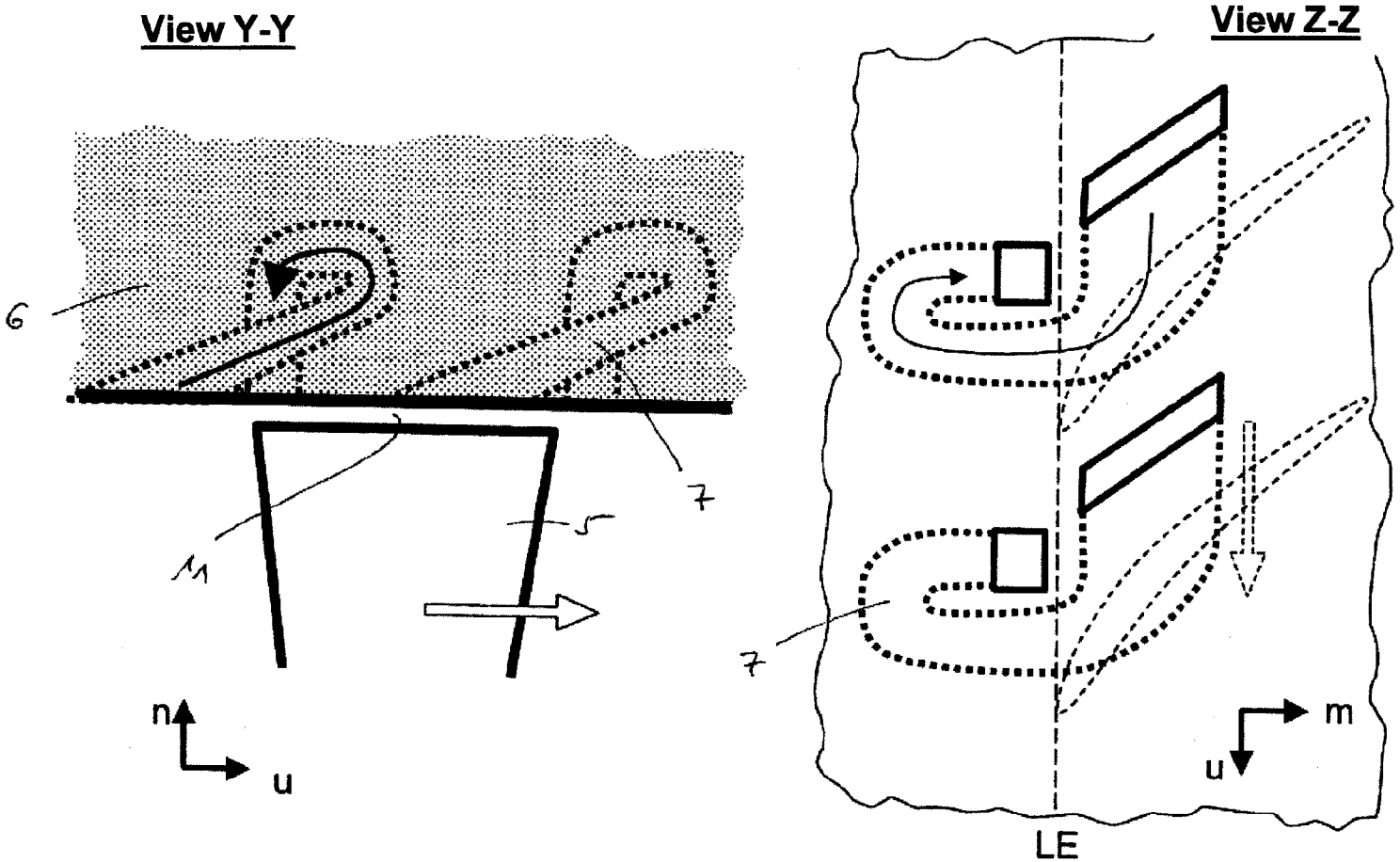
Figure 4E:
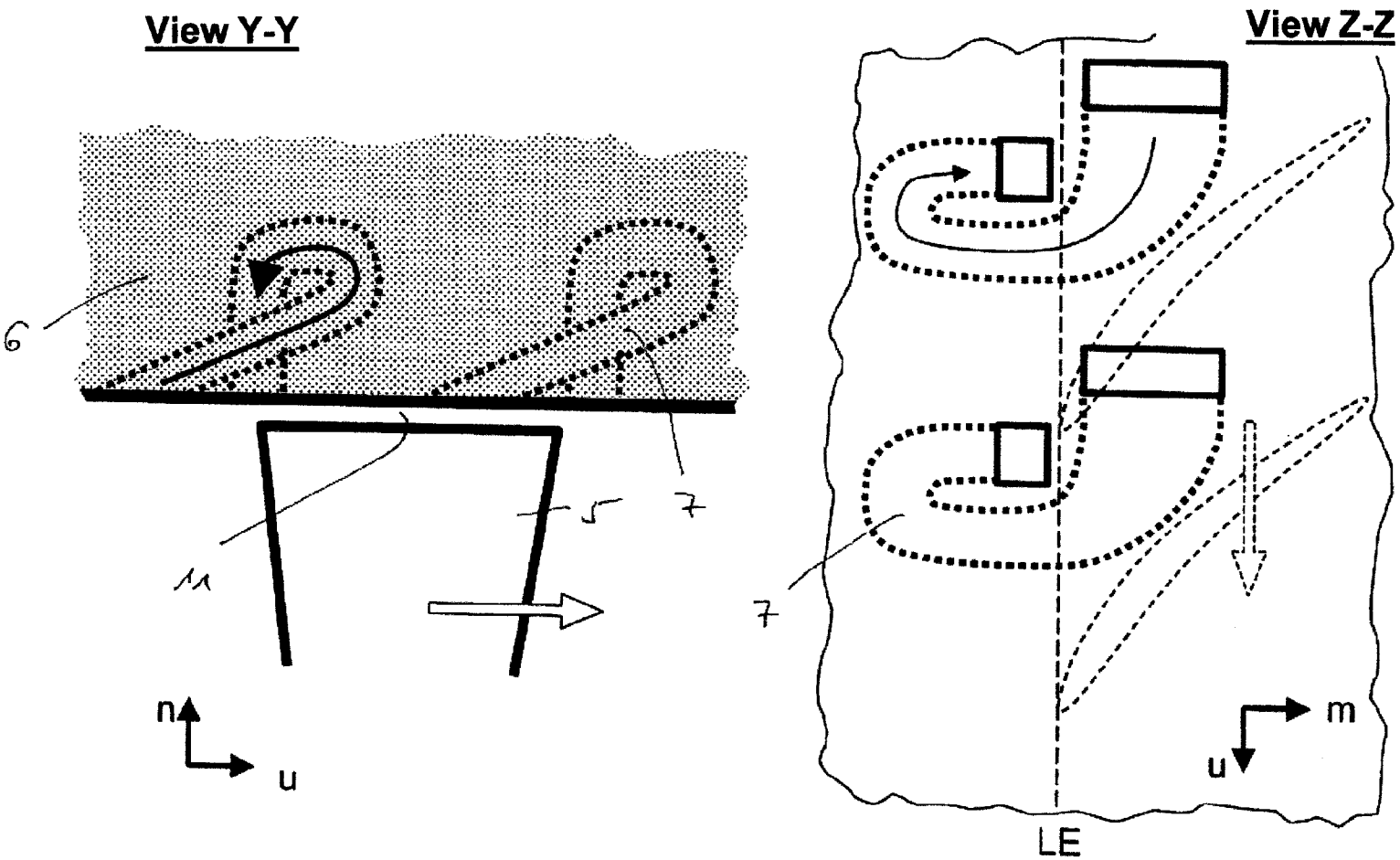
Figure 4F:
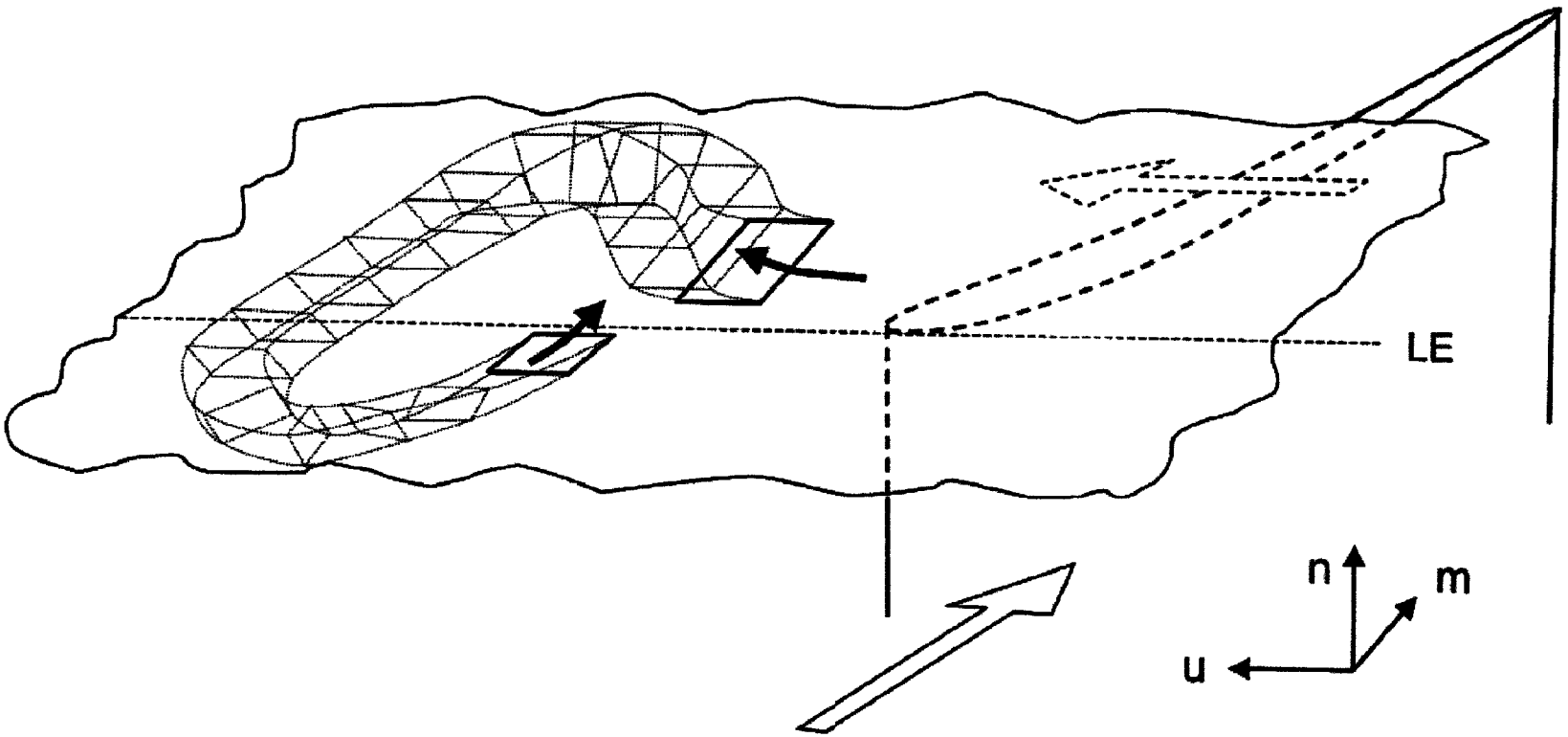
Figure 4G:
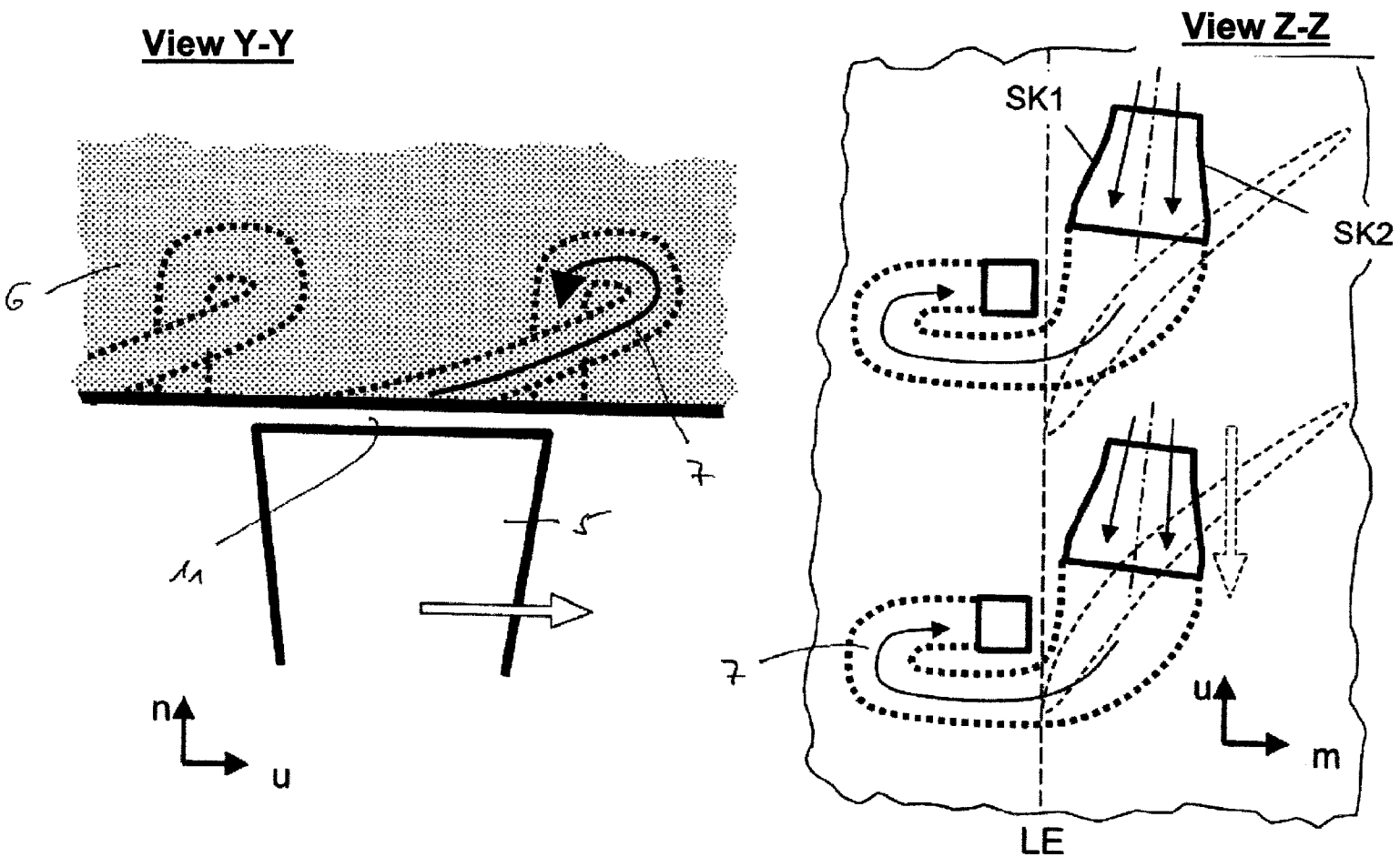
Figure 4H:
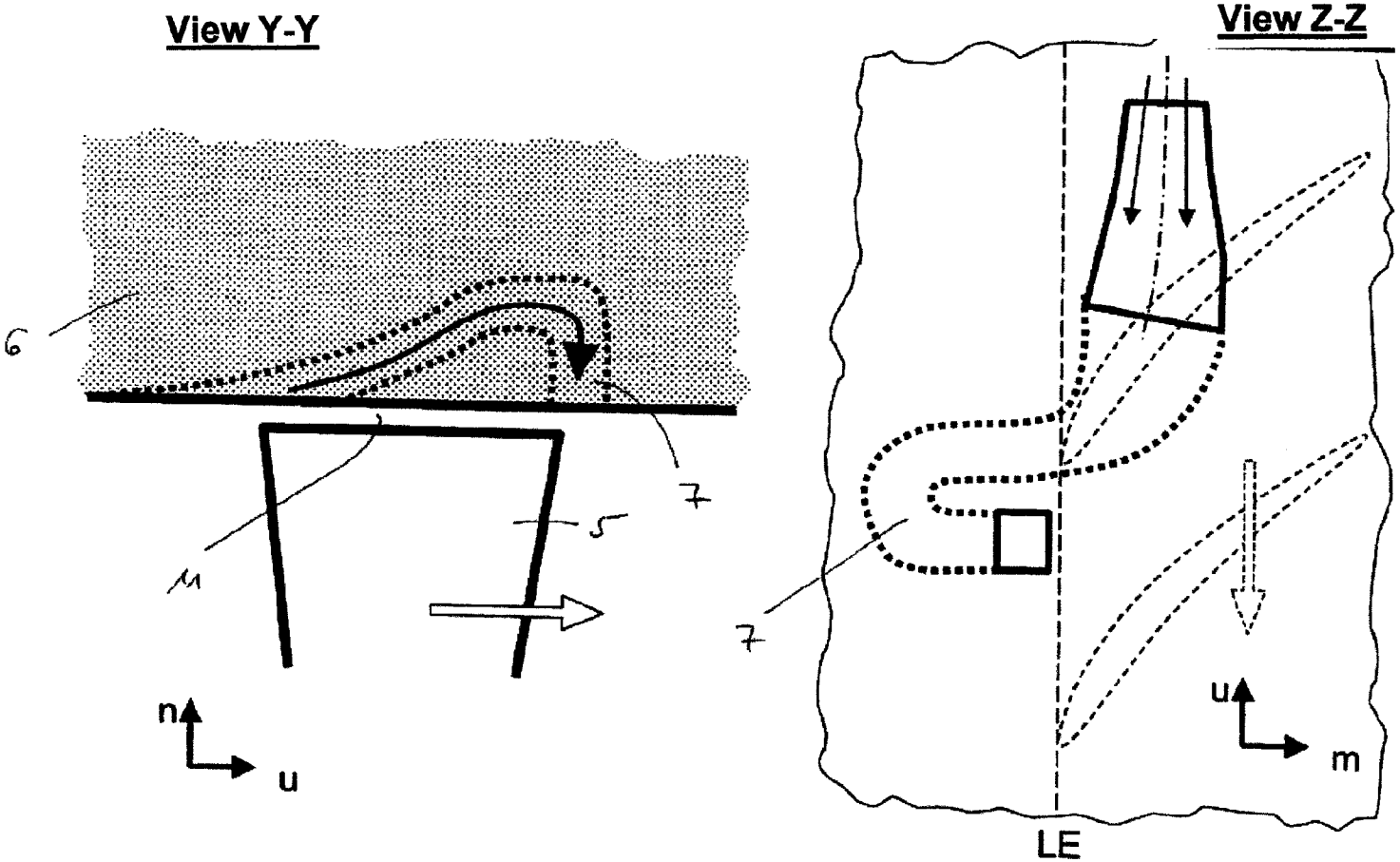
Figure 4I:
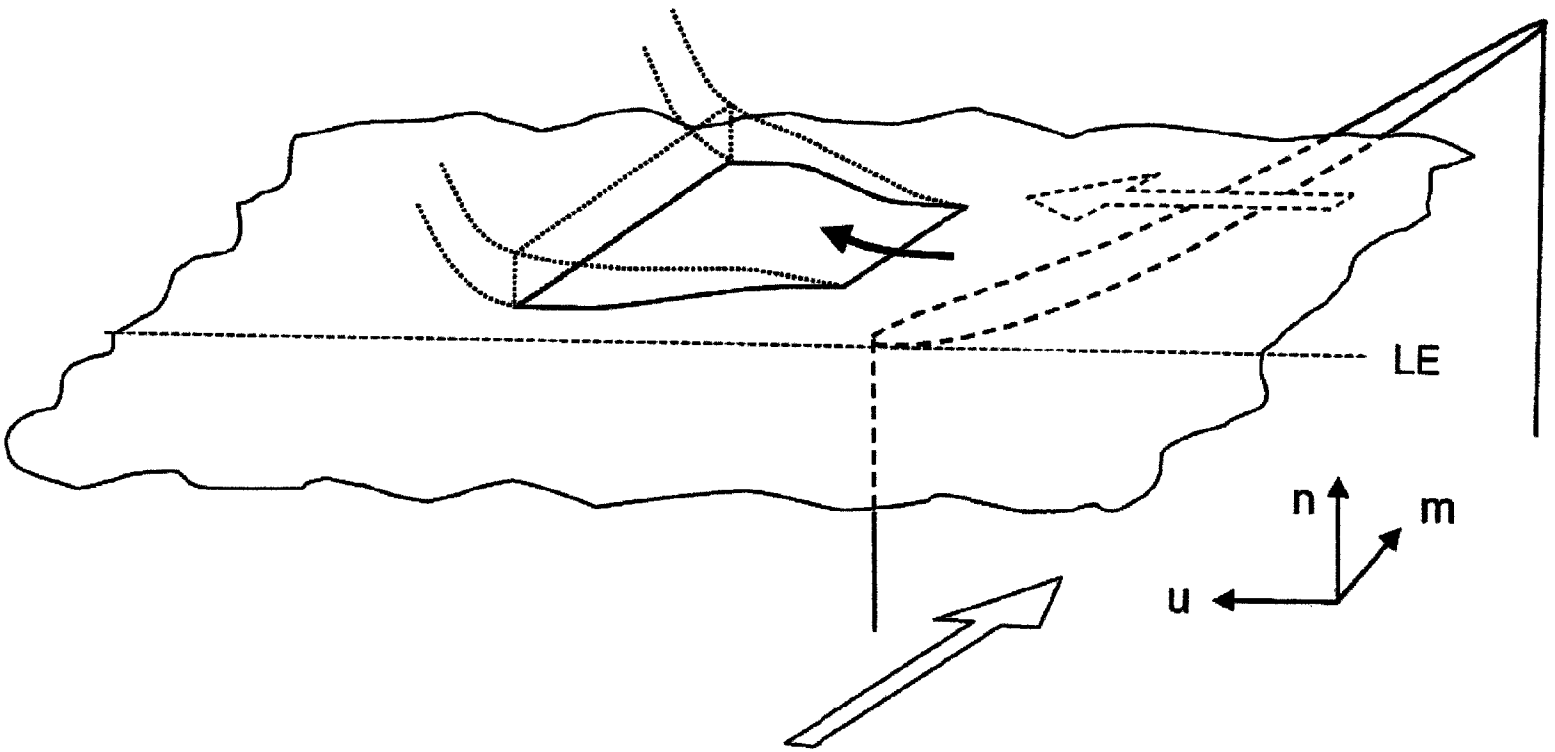
Figure 4J:
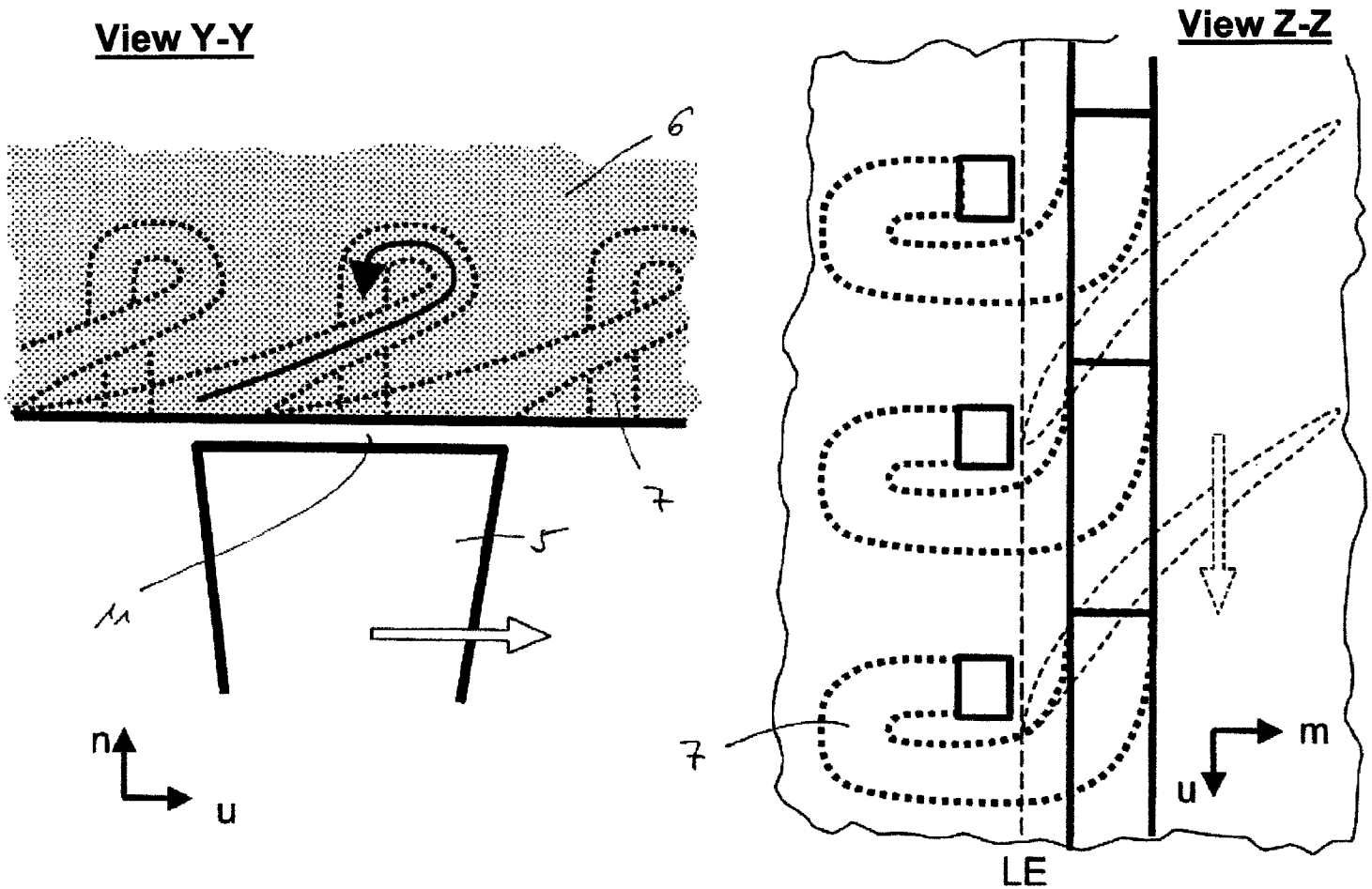
Figure 5A:
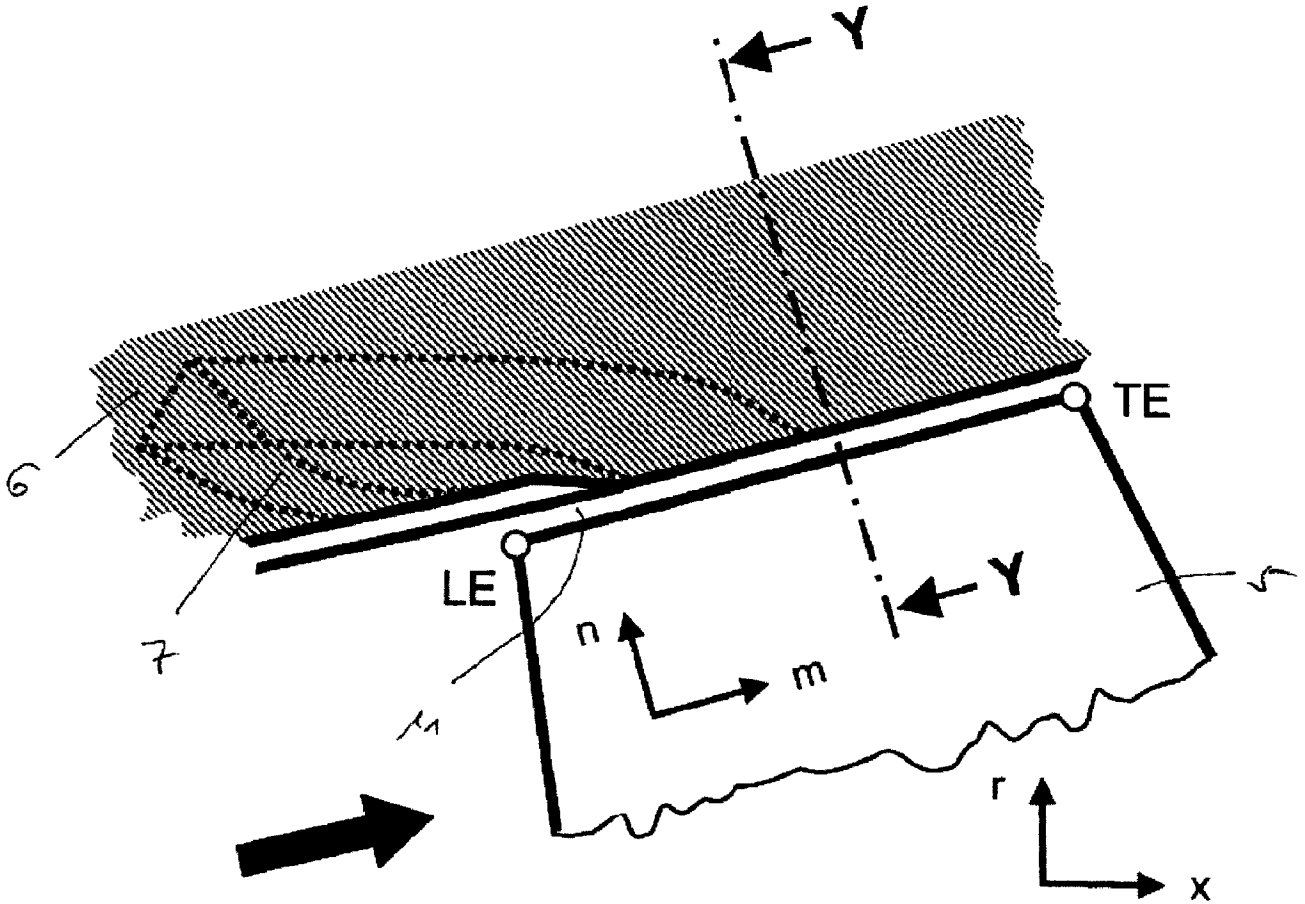
Figure 5B:
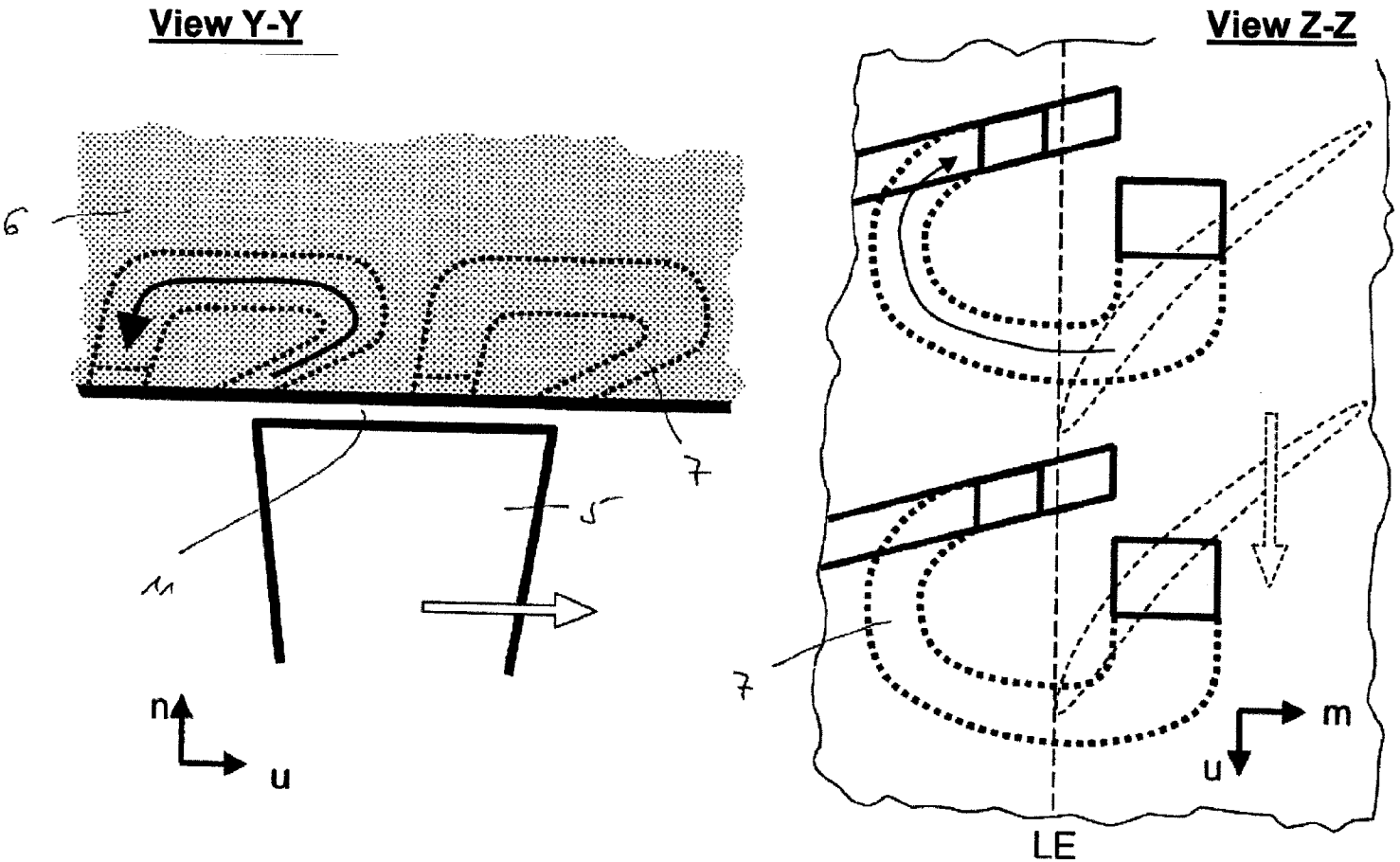
Figure 6B:
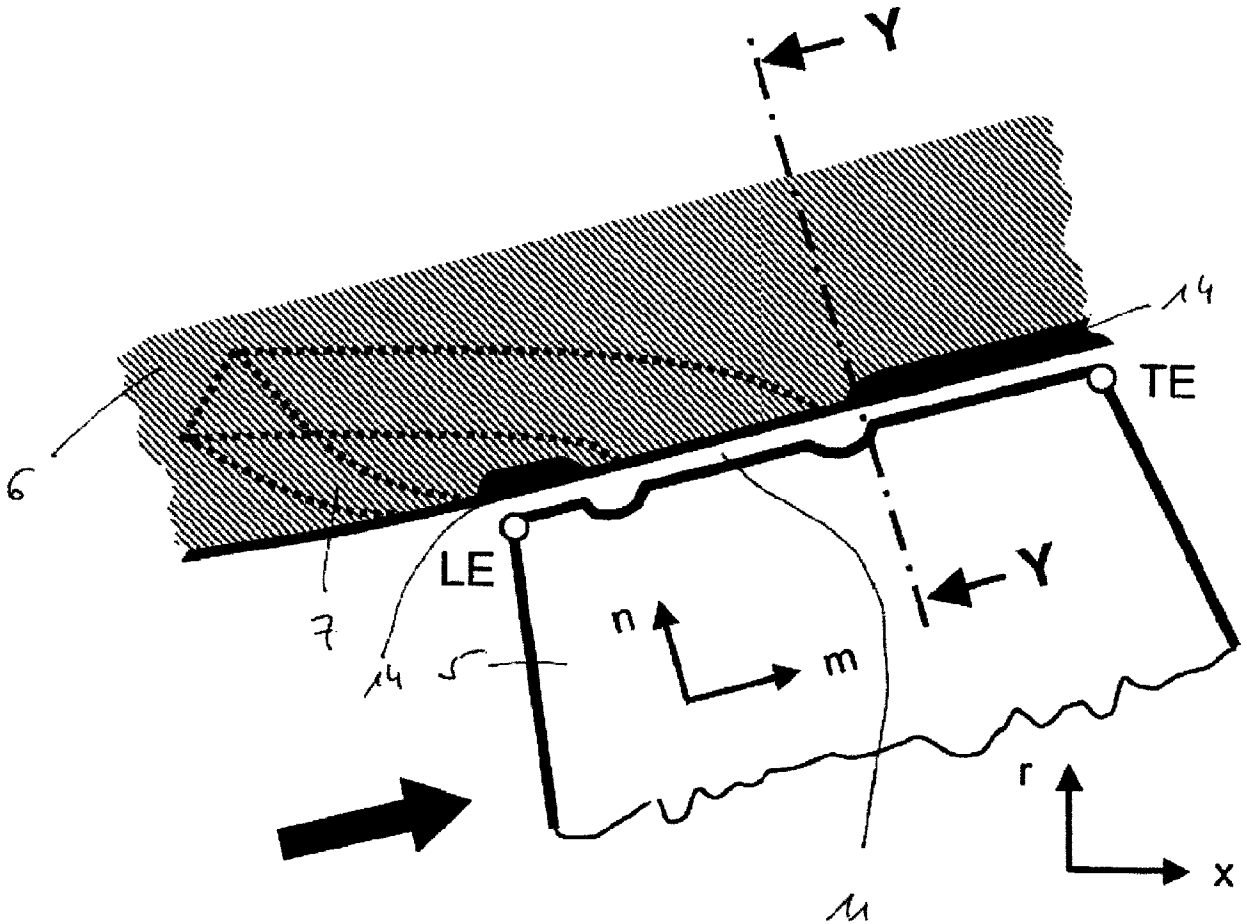
Figure 6C:
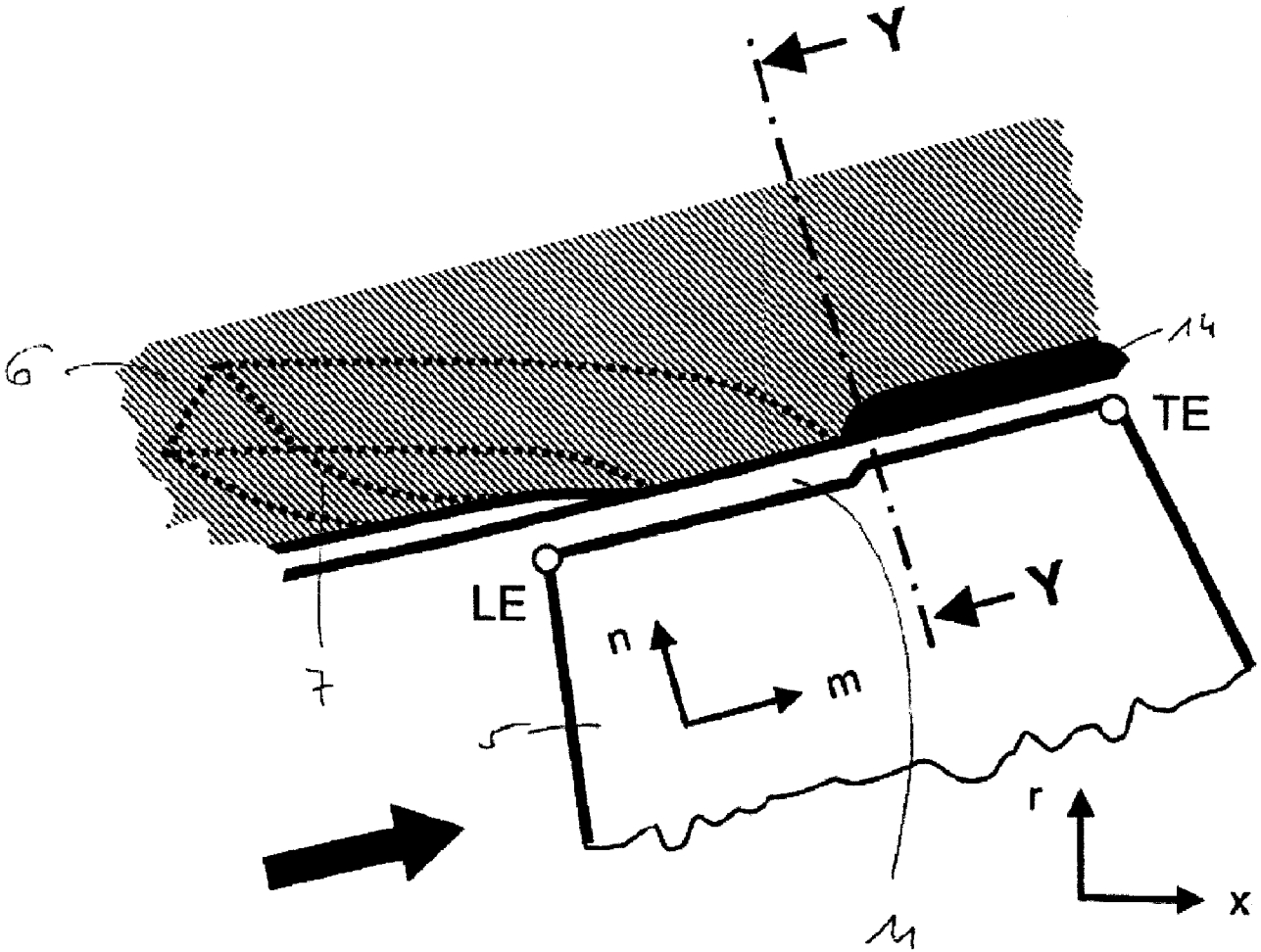
Figure 7:
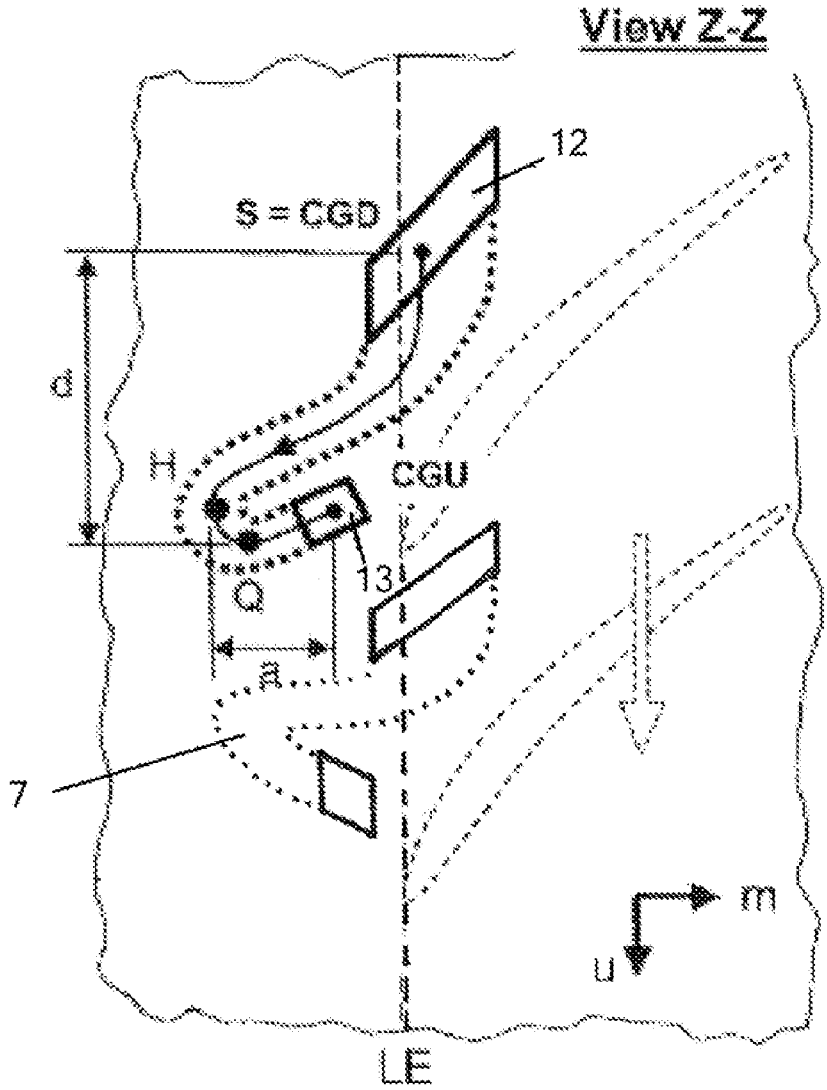

The present invention is more fully described in light of the accompanying figures showing preferred embodiments:

FIG. 1*a* is a sketch of the state of the art, rotor casing, circumferential grooves, FIG. 1*b* is a sketch of the state of the art, rotor casing treatment, FIG. 2 shows examples of fluid flow machines relevant to the present invention, FIG. 3*a* shows the solution in accordance with the present invention, meridional section, FIG. 3*b* shows the solution in accordance with the present invention, meridional section, FIG. 3*c* shows the solution in accordance with the present invention, meridional section, further denominations, FIG. 3*d* shows the solution in accordance with the present invention, views Y-Y and Z-Z, FIG. 3*e* shows the solution in accordance with the present invention, view Z-Z, further denominations, FIG. 3*f* shows the solution in accordance with the present invention, views Y-Y and Z-Z, FIG. 3*g* shows the solution in accordance with the present invention, views Y-Y and Z-Z, FIG. 3*h* shows the solution in accordance with the present invention, views Y-Y and Z-Z, FIG. 3*i* shows the solution in accordance with the present invention, views Y-Y and Z-Z, FIG. 3*j* shows the solution in accordance with the present invention, views Y-Y and Z-Z, FIG. 3*k* shows the solution in accordance with the present invention, views Y-Y and Z-Z, FIG. 3*l* shows the solution in accordance with the present invention, views Y-Y and Z-Z, FIG. 3*m* shows the solution in accordance with the present invention, views Y-Y and Z-Z, FIG. 3*n* shows the solution in accordance with the present invention, views Y-Y and Z-Z, FIG. 4*a* shows the solution in accordance with the present invention, meridional section, FIG. 4*b* shows the solution in accordance with the present invention, views Y-Y and Z-Z, FIG. 4*c* shows the solution in accordance with the present invention, views Y-Y and Z-Z, FIG. 4*d* shows the solution in accordance with the present invention, views Y-Y and Z-Z, FIG. 4*e* shows the solution in accordance with the present invention, views Y-Y and Z-Z, FIG. 4*f* shows the solution in accordance with the present invention, spatial view, FIG. 4*g* shows the solution in accordance with the present invention, views Y-Y and Z-Z, FIG. 4*h* shows the solution in accordance with the present invention, views Y-Y and Z-Z, FIG. 4*i* shows the solution in accordance with the present invention, spatial view, FIG. 4*j* shows the solution in accordance with the present invention, views Y-Y and Z-Z, FIG. 5*a* shows the solution in accordance with the present invention, spatial view, FIG. 5*b* shows the solution in accordance with the present invention, views Y-Y and Z-Z, FIG. 6*a* shows the solution in accordance with the present invention, spatial view, FIG. 6*b* shows the solution in accordance with the present invention, spatial view, FIG. 6*c* shows a further embodiment in accordance with the present invention, FIG. 7 shows a further embodiment in accordance with the present invention.

FIG. 3*a* shows the inventive solution of a blade row 5 with free end and running gap 11 represented in the meridional plane established by the axial direction x and the radial direction r.

The running gap 11 separates the blade tip from a component appertaining to the main flow path 2 on the hub 3 or the casing 1 of the fluid flow machine.

A rotary relative movement exists between the blade tip and the component appertaining to the main flow path. The representation therefore similarly applies to the following arrangements:

1.) Rotary blade on stationary casing,

2.) Stationary blade on rotary hub,

3.) Stationary blade on rotary casing,

4.) Rotary blade on stationary hub.

The main flow direction is indicated by a bold arrow. Upstream and/or downstream of the blade row with running gap 11, further blade rows can be disposed. The leading edge point of the blade 5 on the running gap is marked LE. The trailing edge point of the blade 5 on the running gap 11 is marked TE.

Within the component appertaining to the main flow path 2, a number of circumferentially distributed reversing ducts 7 is provided in the area of the running gap 11. Each reversing duct 7 connects an offtake opening 12 with a further upstream provided supply opening 13. The figure shows the outline, or the projection, respectively, of a single reversing duct 7 in the meridional plane. A slender arrow shows the flow course provided by the present invention through the reversing duct 7 in this plane.

The course of the reversing duct 7 is such that fluid is tapped from the rim of the main flow path 2 via the opening 12, oriented near the main flow path 2 essentially in parallel with the main flow path confinement, routed upstream, opposite to the main flow direction, and, finally, rerouted by flow reversal into the main flow path via opening 13 at a shallow angle to the main flow direction 2.

The reversing duct 7 has a circumferential extension and shaping which is not recognizable in the meridional plane here viewed. Flow direction reversal from "opposite to the main flow" to "with the main flow" is for the most part provided in accordance with the present invention in the plane established by the circumferential direction u and the meridional direction m.

The centerline of the reversing duct 7 is established by connecting all cross-sectional centroids of the reversing duct 7. The projection of the centerline to the meridional plane is shown in FIGS. 3*a* and 3*b* as an arrow indicating the fluid course. The inclination of the centerline relative to the main flow path confinement is a characterizing feature according to the present invention and is measured by the inclination angle $\alpha$ formed between a parallel to the tangent to the main flow path confinement in point CGD and the tangent to the projected centerline of the reversing duct. An upstream oriented inclination of the centerline according to the sense depicted results in angular values of $\alpha>90°$ and, upon fluid direction reversal, angular values of $\alpha>270°$ can result, in particular in the vicinity of the supply opening.

The meridional coordinate m shows in the main flow direction and can, with corresponding inclination of the flow path, be inclined against the axial direction x, as shown in the figure. The normal direction to m is indicated by the normal coordinate n.

In further illustrations of the solution according to the present invention, reference is made to views Y-Y and Z-Z depicted in FIG. 3*a* to further elucidate the inventive concept. View Y-Y is opposite to the main flow direction and clarifies the geometry of the reversing ducts 7 according to the present invention in the plane established by the circumferential coordinate u and the normal coordinate n.

View Z-Z shows the developed surface of the main flow path confinement and illustrates the geometry of the reversing ducts 7 according to the present invention in the plane established by the meridional coordinate m and the circumferential coordinate u.

FIG. 3*b* shows a variant of the configuration of the reversing duct 7 shown in FIG. 3*a*. Here, the reversing duct 7 is provided such that fluid is tapped from the rim of the main flow path, oriented near the main flow path in the upstream direction at a shallow angle to the main flow path confinement, routed upstream, opposite to the main flow direction, and, finally, rerouted by flow reversal into the main flow path 2 also at a shallow angle to the main flow path confinement.

Particularly favorable embodiments according to the present invention are obtained if the projection of the centerline of the reversing duct 7 to the meridional plane makes, in the portion of the reversing duct in which an upstream directed fluid guidance is provided, an angle $\alpha$ between 135° and 225° with the main flow path confinement over at least 60% of the running length of this portion. The portion of the reversing duct with upstream directed fluid guidance is, as depicted in FIG. 3*b*, delimited by the points CGD and H. Here, point CGD is situated in the offtake opening 12 and is the centroid there. Point H is the furthest-most meridionally upstream point of the centerline of the reversing duct 7. In the portion between point H and point CGU (centroid of the supply opening 13), the fluid is conducted in the downstream direction.

Favorable solutions according to the present invention provide that the fluid guidance from point H is exclusively oriented towards the main flow path confinement and the reversing duct 7 in this portion approaches the main flow path in the main flow direction at an increasingly shallow angle. In the portion of the reversing duct with downstream directed fluid guidance, the following shall then apply: $270<\alpha<360°$. Particularly favorable solutions provide for an inclination angle at the supply opening of $\alpha>335°$.

FIG. 3*c* defines further invention-relevant quantities. Shown here are only the main flow path confinement, a part of the blade and the centerline of the reversing duct 7 with its characterizing points CGD, CGU and H. Distances between these points are measured vertically or parallelly, respectively, to the tangent to the main flow path confinement in point CGD. Hence, the meridional distance "a" lies between the points CGU and H and the meridional distance "b" between the points CGD and H. The normal height "h" is established vertically thereto as distance between CGD and H. The quantities a, b and h enable dimensional relations according to the present invention to be established for the reversing duct 7. Accordingly, it is particularly favorable in accordance with the present invention if the entire reversing duct 7 is provided close to the main flow path, resulting in a ratio of h to b of less than 0.6 ($h/b<0.6$). A particularly favorable shallow design according to the present invention is provided with values $h/b<0.3$.

FIG. 3*d* shows the solution according to the present invention depicted in FIGS. 3*b* and 3*c* in views Y-Y and Z-Z. View Z-Z on the right-hand side of the figure shows a portion of the developed main flow path confinement in the plane established by the circumferential direction u and the meridional direction m. For clarity, the blade tips of the blade row considered as well as the connection of the leading edge points LE are depicted by broken lines, although they do not lie in the viewing plane Z-Z.

The distance between two adjacent profiles at the blade tip is marked tS, indicating the blade pitch. The distance between two adjacent centroids of an offtake opening is marked tD. The distance between two adjacent centroids of a supply opening is marked tU.

The broken bold arrow indicates the circumferential relative movement between the blades and the main flow path confinement. The arrangement according to the present invention includes a number of circumferentially distributed reversing ducts, with each reversing duct connecting an offtake opening OD to a centroid CGD and a supply opening OU to a centroid CGU.

The curved thin arrow in one of the reversing ducts is the projection of the centerline of the reversing duct in the plane m-u.

The location of the centroids is of primary relevance to the present invention, while the precise shape of the offtake and supply openings is of secondary importance.

In accordance with the present invention the following shall apply:

1.) the centroid CGU is provided upstream of the leading edge line LE,

2.) the centroid CGD is provided downstream of the leading edge line LE.

Here, the offtake opening OD may be provided partly or completely downstream of the leading edge line, and the supply opening OU partly or completely upstream of the leading edge line.

It is advantageous in accordance with the present invention, if at least one of the distances tU (distance between two adjacent centroids of a supply opening 13) and tD (distance between two adjacent centroids of an offtake opening 12) is an integer multiple or an integer divisor of the blade pitch tS. This includes of course the cases tU=tS and tD=tS.

View Y-Y on the left-hand side of the illustration shows a portion of the main flow path confinement with several reversing ducts, represented in a plane established by the circumferential direction u and the normal direction n. The curved thin arrow depicted in one of the reversing ducts is exemplary of all reversing ducts and indicates the course of fluid guidance. Also depicted is a blade tip and a bold arrow indicating the running direction thereof in relation to the main flow path confinement.

FIG. 3*e* shows further invention-relevant quantities in a portion of view Z-Z from the previous FIG. 3*d*. Only shown here are a selected reversing duct 7 with its two openings and the (projection of the) centerline. Besides the centroids of the offtake and supply openings CGD and CGU, further characterizing points are defined: the known point of maximum upstream extension H, the point of maximum circumferential extension against the relative movement direction of the blade row S, and the point of maximum circumferential extension in the direction of the relative movement of the blade row Q.

In cases according to the present invention in which one of the centroids CGU and CGD forms a circumferentially outmost point, the point S or the point Q are identical with CGU or CGD.

Distances between these points are measured vertically or parallelly, respectively, to the meridional direction m. Hence, the known meridional distance a lies between the points CGU and H and the distance d between the points S and Q. The quantities a and d enable further dimensional relations according to the present invention to be established for the reversing duct 7. Accordingly, it is favorable in accordance with the present invention if fluid reversal from "upstream" to "downstream", which is to be continuous (not abrupt), is for the most part provided in the plane m-u, resulting in a ratio of h to d of less than 1 ($h/d<1$). A particularly favorable fluid reversal according to the present invention is provided with values $h/d<0.7$.

According to the present invention, low-loss fluid reversal is advantageous at a ratio of a to d of less than 1.5, while being particularly favorable at ratios $a/d<0.7$. As shown by the configuration in FIGS. 3*d* and 3*e*, the supply opening 13 can, according to the present invention, be circumferentially offset to the offtake opening 12 of the same reversing duct 7 opposite to the relative movement of the blade row 5.

FIG. 3*f* now shows a configuration according to the present invention, in which the supply opening 13 is circumferentially offset to the offtake opening 12 of the same reversing duct 7 in the direction of the relative movement of the blade row 5. As already stated in the above, the precise shape of the offtake and supply openings is secondary. Shown here is an example of elliptical opening cross-sections.

FIG. 3*g* shows a configuration according to the present invention, in which the supply opening 13 is circumferentially offset to the offtake opening 12 of the same reversing duct 7 opposite to the relative movement of the blade row 5. The ratio of a/d is here markedly below 1.

As conveyed by view Y-Y, the reversing duct 7, starting out from the offtake opening 12, is initially inclined in the direction of the relative movement of the blade row. According to the present invention, the initial inclination of the reversing duct 7 in plane u-n is defined by the angle β included between the main flow path confinement and the projection of the centerline of the reversing duct in this plane. Here, inclination angles β of less than 45° are particularly favorable.

FIG. 3*h* shows a configuration according to the present invention, in which the supply opening 13 is circumferentially offset to the offtake opening 12 of the same reversing duct 7 in the direction of the relative movement of the blade row. The ratio of a/d is here close to 1. As shown in view Y-Y (plane u-n), the reversing duct, starting out from the offtake opening 12, is here again initially inclined in the direction of the relative movement of the blade row 5.

FIG. 3*i* shows a configuration according to the present invention, in which the supply opening 13 is circumferentially offset to the offtake opening 12 of the same reversing duct 7 opposite to the relative movement of the blade row 5. The ratio of a/d is here markedly above 1. As an advantageous feature according to the present invention, this figure shows that at least part of the confinement edges of the offtake opening 12 are essentially oriented in the direction of the blade profile chord.

This means small differences between the inclination of the tangent to the offtake opening 12 (angle $\epsilon$) and the inclination of the profile chord (angle $\lambda$) amounting to less than 15°.

View Y-Y shows that, here again, the reversing duct, starting out from the offtake opening 12, is initially inclined in the direction of the relative movement of the blade row. Furthermore, the reversing duct is also inclined in the direction of the relative movement of the blade row in the area of the supply opening 13. This final inclination of the reversing duct in the plane u-n is, in accordance with the present invention, defined by the angle $\gamma$ included between the main flow path confinement and the projection of the centerline of the reversing duct 7 in this plane. Here, inclination angles $\gamma$ between 30° and 150° are particularly favorable ($30° < \gamma < 150°$).

FIGS. 3*j* and 3*k* show further similar configurations according to the present invention.

FIG. 3*l* shows a further particular feature of the reversing duct 7 falling within the scope of the present invention. In view Y-Y (plane u-n), a (projected) centerline with crossing is here provided such that the reversing duct 7, starting out from the offtake opening 12, departs from the main flow path confinement at a certain inclination angle, then takes a loop-type course by which it is returned in the direction of the supply opening 13 to the main flow path confinement.

FIGS. 3*m* and 3*n* show configurations of the reversing duct 7 according to the present invention, in which the centroid CGU of the supply opening 13, with reference to its circumferential position (direction u) is provided between the centroids CGD of the offtake openings of the next two adjacent reversing ducts 7, resulting in overlapping of adjacent reversing ducts 7 in view Y-Y (plane u-n). The illustration here even shows the special case that the supply opening 13, with reference to its circumferential position (direction u), is disposed between the offtake openings 12 of the next two adjacent reversing ducts 7.

FIG. 4*a* shows a further variant of the reversing duct 7 in accordance with the present invention. Also here, the reversing duct is basically provided such that fluid is tapped from the rim of the main flow path 2, oriented near the main flow path 2 in the upstream direction at a shallow angle to the main flow path confinement, routed upstream opposite to the main flow direction and, finally, rerouted by flow reversal into the main flow path 2 also at a shallow angle to the main flow path confinement. The offtake opening 12 is here however disposed completely downstream of the leading edge line LE. Favorable solutions according to the present invention, with reference to the meridional flow direction m, provide for an arrangement of the centroid CGD of the offtake opening 12 between the leading edge LE and a point at half the profile depth on the blade tip (point M, centrally between LE and TE).

FIGS. 4*b* to 4*e* show several inventive variants of the reversing duct 7 from FIG. 4*a* in view Y-Y (plane u-n) and in view Z-Z (plane m-u).

FIG. 4*f* shows a spatial representation of the reversing duct 7 from FIGS. 4*a* and 4*e*.

FIGS. 4*g* and 4*h* each show a variant according to the present invention in which the offtake opening 12 is formed by a particularly shallow ram inlet. This is characterized, firstly, by an inclination angle of the projected centerline in the plane u-n of $\beta < 25°$. Particularly favorable is a course of the lateral edges SK1 and SK2 of the offtake opening 12 which diverges in the inflow direction. The offtake opening 12 and the edges thereof can be symmetrical or straight, as shown in FIG. 4*g*, or curved, as shown in FIG. 4*h*. FIG. 4*i* finally shows a spatial representation of the offtake opening 12 according to the present invention.

FIG. 4*j* shows a variant according the present invention in which the offtake openings 12 of adjacent reversing ducts 7 directly adjoin each other. While the variant shown represents a rectilinear edge arrangement, other variants with offtake openings 12 of adjacent reversing ducts 7 adjoining in at least one point will also fall within the scope of the present invention.

FIGS. 5*a* and 5*b* show a solution according to the present invention in which the supply opening 13 is provided in a groove extending downstream to behind the leading edge line. The groove can here be parallel or, as shown here, inclined to the meridional flow direction.

FIGS. 6*a* to 6*c* show solutions according to the present invention for configurations provided with an abradable coating on the main flow path confinement. FIG. 6*a* shows the case of a two-part abradable coating 14 of which one part is arranged before and one part behind the zone of the offtake openings 12. The blade has a shallow recess over the area not covered by the abradable coating 14.

FIG. 6*b* again shows the case of a two-part abradable coating 14 of which one part is provided before and one part behind the zone of the offtake openings 12. Here, the blade is provided with a shallow recess only in each of the two short areas situated between the area of the offtake openings 12 and the respective rim of the abradable coating 14.

FIG. 6*c* shows a case with a shortened abradable coating 14 provided behind the zone of the offtake openings 12. Disposed before the offtake opening 12 is a number of grooves which extend into the bladed area and in which the supply openings of the reversing ducts are situated. Here, the blade has a shallow recess extending to the leading edge.

FIG. 7 shows an alternative embodiment where alternating reversing ducts have different configurations (as previously shown in FIGS. 3*j* and 3*k*).

Summarizing then, the present invention can be described as follows:

Fluid flow machine with a main flow path which is confined by a hub and a casing and in which at least one row of blades is arranged, with a gap being provided on at least one blade row between a blade end and a main flow path confinement, with the blade end and the main flow path confinement performing a rotary movement relative to each other, and with at least one reversing duct being provided in the area of the blade leading edge in the main flow path confinement at a discrete circumferential position, with a) a reversing duct connecting two openings arranged on the main flow path confinement, b) fluid flowing from the main flow path via an offtake opening into the reversing duct, and the centroid CGD of the offtake opening being situated downstream of the leading edge of the blade tip, c) fluid flowing from the reversing duct via a supply opening into the main flow path, and the centroid CGU of the supply opening being situated upstream of the leading edge of the blade tip, d) the course of the reversing duct being spatially compact, such that fluid is routed upstream near the main flow path against the main flow direction and rerouted exclusively by flow reversal into the main flow path at a shallow angle, e) the reversing duct having a centerline being defined as the connection of all centroids of the cross-sections of the reversing duct and, due to its three-dimensional shape, not extending completely in one plane, with the centerline of at least one reversing duct having a reversing point H identifying the furthest-most meridionally upstream position of the centerline, and with the projection of the centerline to the meridional plane (plane x-r), in the portion of upstream fluid guidance (portion between the points CGD and H), forming an angle $\alpha$ between 135° and 225° with the tangent to the main flow path confinement in point CGD over at least 60% of the running length of this portion, with the centroid of the supply opening and the centroid of the offtake opening of the same reversing duct being circumferentially offset to each other opposite to the relative movement of the blade row, with the projection of the centerline of at least one reversing duct to the meridional plane (plane x-r), in the portion between the reversing point H and the centroid CGU of the supply opening being exclusively oriented towards the main flow path confinement and at an increasingly shallow angle approaching the main flow path, characterized by inclination angles $\alpha$ greater than 335° in point CGU, with the spatial compactness of at least one reversing duct in the meridional plane (plane x-r) being provided by further characteristics, with a) a distance a being provided between the points CGU and H in the direction of the tangent to the main flow path confinement in point CGD, b) a distance b being provided between the points CGD and H in the direction of the tangent to the main flow path confinement in point CGD, c) the height h being provided between the points CGD and H vertically to the tangent to the main flow path confinement in point CGD, d) the ratio of height h to distance b being less than 0.6, with the ratio of height h to distance b being less than 0.3, with, when viewing the configuration in the plane established by the circumferential direction u and the meridional direction m, a blade pitch tS being provided in the circumferential direction between two each adjacent blade tips, a distance tU being provided between two each adjacent centroids of a supply opening, and a distance tD being provided between two each adjacent centroids of an offtake opening, with at least one of the two distances tU and tD being an integer multiple or an integer divisor of the blade pitch tS, with the spatial compactness of at least one reversing duct in the plane established by the circumferential direction u and the meridional direction m being provided by further characteristics, with a) the projection of the centerline to the plane u-m having a point S marking the maximum extension of the centerline opposite to the relative movement direction of the blade row, b) the projection of the centerline to the plane u-m having a point Q marking the maximum extension of the centerline in the direction of the relative movement of the blade row, c) the distance a between the points CGU and H being provided in the meridional direction m, d) the distance d between the points S and Q being provided in the circumferential direction u, e) a ratio of distance a to distance d of less than 1.5 being provided, with a ratio of distance a to distance d of less than 0.7 being provided, with the ratio of height h to distance d being less than 1, with the ratio of height h to distance d being less than 0.7, with, when viewing the configuration in the plane established by the circumferential direction u and the normal direction n, at least one reversing duct being inclined in the area of the offtake opening in the direction of the relative movement of the blade row, with the angle $\beta$ between the main flow path confinement and the projection of the centerline to the plane u-n in point CGD being less than 45°, with at least one tenth of the length of the confinement edge of the offtake opening being oriented essentially in the direction of the blade profile chord, so that in the respective portion small differences amounting to less than 15° exist between the inclination of the tangent to the offtake opening (angle $\epsilon$) and the inclination of the profile chord (angle $\lambda$), with, when viewing the configuration in the plane established by the circumferential direction u and the normal direction n, at least one reversing duct being inclined in the area of the supply opening, with the angle $\gamma$ between the main flow path confinement and the projection of the centerline to the plane u-n in point CGU being between 30° and 150°, with, when viewing the configuration in the plane established by the circumferential direction u and the normal direction n, the centerline of at least one reversal duct projected to this plane having a crossing such that the centerline obliquely departs from main flow path confinement and then arcs in the opposite direction back to the main flow path confinement, thus taking a loop-type course with a crossing point outside of the main flow path, with the centroid CGU of the supply opening of at least one reversing duct, with reference to its circumferential position (direction u), being disposed between the centroids CGD of the offtake openings of the next two adjacent reversing ducts each, thus providing for an overlap of adjacent reversing ducts when viewing the configuration in the plane established by the circumferential direction u and the normal direction n, with the offtake opening of at least one reversing duct being disposed completely downstream of the leading edge line LE, and with the centroid CGD of the offtake opening being provided in the meridional flow direction m between the leading edge LE and a point at half the profile depth of the blade tip (centrally between LE and TE), with the offtake opening of at least one reversing duct being formed by a shallow ram inlet, with an inclination angle $\beta$ of the projected centerline in the plane u-n against the main flow path confinement of less than 25° being provided, with the course of the lateral edges SK1 and SK2 of the offtake opening of at least one reversing duct diverging in the inflow direction, with the offtake openings of adjacent reversing ducts directly adjoining each other in at least one point, with the supply opening of at least one reversing duct being provided in a groove extending downstream to behind the leading edge line, with a two-part abradable coating, of which one part is arranged upstream and one part downstream of the offtake zone of the reversing ducts, being provided in the area of the running gap of the blade row, and with the blade tip at the running gap having one shallow recess in the area not covered by the abradable coating, with a two-part abradable coating, of which one part is arranged upstream and one part downstream of the offtake zone of the reversing ducts, being provided in the area of the running gap of the blade row, and with the blade tip at the running gap having two short, shallow recesses arranged in the area between the offtake zone and the respective part of the abradable coating, with a shortened abradable coating being provided downstream of the offtake zone of the reversing ducts in the area of the running gap of the blade row, with a number of grooves containing supply openings being located in the main flow path confinement upstream of the offtake zone, and with the blade tip at the running gap having a shallow recess extending to the leading edge, with reversing ducts with different shape, position or extension being provided along the circumference of the main flow path confinement.

LIST OF REFERENCE NUMERALS

1 Casing
2 Annulus duct/main flow path
3 Rotor drum (hub)
4 Machine axis
5 Blade/blade row
6 Hub or casing assembly
7 Reversing duct
9 Upstream blade row (optional)
10 Slot/groove
11 Gap/running gap
12 Offtake opening
13 Supply opening
14 Abradable coating

What is claimed is:

1. A fluid flow machine comprises:

a hub;

a casing;

a main flow path confined by the hub and the casing;

at least one row of blades arranged in the main flow path;

a gap provided on the at least one row of blades between blade tips and a main flow path confinement, with the blade tips and the main flow path confinement performing a rotary movement relative to each other;

at least one reversing duct provided in an area of leading edges of the blades in the main flow path confinement at a discrete circumferential position, with:

a) the at least one reversing duct having and connecting an offtake opening to a supply opening, both arranged on the main flow path confinement, b) fluid flowing from the main flow path via the offtake opening into the at least one reversing duct, a centroid CGD of the offtake opening being situated downstream of the leading edges of the blade tips, c) fluid flowing from the at least one reversing duct via the supply opening into the main flow path, a centroid CGU of the supply opening being situated upstream of the leading edges of the blade tips, d) a course of the at least one reversing duct being spatially compact, such that fluid is routed upstream near the main flow path against a main flow direction and rerouted exclusively by flow reversal into the main flow path at a shallow angle, e) the at least one reversing duct having a centerline being defined as a connection of all centroids of cross-sections of the at least one reversing duct, that due to its three-dimensional shape, does not extend completely in one plane;

wherein a course of lateral edges SK1 and SK2 of the offtake opening of the at least one reversing duct diverges in an inflow direction.

2. The fluid flow machine of claim 1, wherein the centerline of the at least one reversing duct has a reversing point H identifying a furthest-most meridionally upstream position of the centerline, and in that a projection of the centerline to a meridional plane x-r, in a portion of upstream fluid guidance between the points CGD and H, forms an angle $\alpha$ of between 135° and 225° with a tangent to the main flow path confinement in point CGD, over at least 60% of the running length of this portion.

3. The fluid flow machine of claim 2, wherein a projection of the centerline of the at least one reversing duct to the meridional plane x-r, in a portion between the reversing point H and the centroid CGU of the supply opening is exclusively oriented towards the main flow path confinement and at an increasingly shallow angle approaches the main flow path, with an inclination angle greater than 335° in point CGU.

4. The fluid flow machine of claim 2, wherein the spatial compactness of at least one reversing duct in a plane established by a circumferential direction u and a meridional direction m is provided by further characteristics, with:

the projection of the centerline to the plane u-m having a point S marking a maximum extension of the centerline opposite to the relative movement direction of the blade row, the projection of the centerline to the plane u-m having a point Q marking a maximum extension of the centerline in the direction of the relative movement of the blade row, a distance d between the points S and Q being provided in the circumferential direction u, wherein a height h is provided between the points CGD and H vertically to a tangent to the main flow path confinement in point CGD and a ratio of height h to distance d is less than 1.

5. The fluid flow machine of claim 4, wherein the ratio of height h to distance d is less than 0.7.

6. The fluid flow machine of claim 1, wherein the centroid of the supply opening and the centroid of the offtake opening of the at least one reversing duct are circumferentially offset to each other opposite to the relative movement of the blade tips.

7. The fluid flow machine of claim 1, wherein the spatial compactness of the at least one reversing duct in a meridional plane x-r is provided by further characteristics, with:

a) a distance "a" being provided between the points CGU and H in a direction of the tangent to the main flow path confinement in point CGD, b) a distance "b" being provided between the points CGD and H in a direction of the tangent to the main flow path confinement in point CGD, c) a height h being provided between the points CGD and H vertically to the tangent to the main flow path confinement in point CGD, d) a ratio of height h to distance b being less than 0.6.

8. The fluid flow machine of claim 7, wherein the ratio of height h to distance b is less than 0.3.

9. The fluid flow machine of claim 1, wherein, when viewing in a plane established by a circumferential direction u and a meridional direction m, a blade pitch tS is provided in the circumferential direction between two each adjacent blade tips, a distance tU is provided between two each adjacent centroids of a supply opening, and a distance tD is provided between two each adjacent centroids of an offtake opening, and at least one of: one of the two distances tU and tD coincides with tS, one of the two distances tU and tD is an integer multiple of the blade pitch tS and one of the two distances tU and tD is an integer divisor of the blade pitch tS.

10. The fluid flow machine of claim 1, wherein the spatial compactness of at least one reversing duct in a plane established by a circumferential direction u and a meridional direction m is provided by further characteristics, with:

a) a projection of the centerline to the plane u-m having a point S marking a maximum extension of the centerline opposite to the relative movement direction of the blade row, b) the projection of the centerline to the plane u-m having a point Q marking a maximum extension of the centerline in the direction of the relative movement of the blade row, c) a distance a between the points CGU and H being provided in the meridional direction m, d) a distance d between the points S and Q being provided in the circumferential direction u, e) a ratio of distance a to distance d is less than 1.5.

11. The fluid flow machine of claim 10, wherein the ratio of distance a to distance d is less than 0.7.

12. The fluid flow machine of claim 1, wherein when viewing in a plane established by a circumferential direction u and a normal direction n, the at least one reversing duct is inclined in an area of the offtake opening in the direction of the relative movement of the blade tips, with an angle β between the main flow path confinement and a projection of the centerline to the plane u-n in point CGD being less than 45°.

13. The fluid flow machine of claim 1, wherein at least one tenth of a length of a confinement edge of the offtake opening is oriented essentially in a direction of a blade profile chord, so that an angle between an inclination of a tangent to the offtake opening (angle ϵ) and an inclination of the profile chord (angle λ) is less than 15°.

14. The fluid flow machine of claim 1, wherein, when viewing in a plane established by a circumferential direction u and a normal direction n, the at least one reversing duct is inclined in an area of the supply opening, with an angle γ between the main flow path confinement and a projection of the centerline to the plane u-n in point CGU is between 30° and 150°.

15. The fluid flow machine of claim 1, wherein, when viewing in a plane established by a circumferential direction u and a normal direction n, the centerline of the at least one reversal duct projected to this plane has a crossing such that the centerline obliquely departs from the main flow path confinement and then arcs in an opposite direction back to the main flow path confinement, thus taking a loop-type course with a crossing point outside of the main flow path.

16. The fluid flow machine of claim 1, wherein the centroid CGU of the supply opening of the at least one reversing duct, with reference to its circumferential position in a circumferential direction u, is disposed between centroids CGD of offtake openings of a next two adjacent reversing ducts each, thus providing for an overlap of adjacent reversing ducts when viewing in a plane established by the circumferential direction u and a normal direction n.

17. The fluid flow machine of claim 1, wherein the offtake opening of the at least one reversing duct is disposed completely downstream of a leading edge line LE, and that the centroid CGD of the offtake opening is provided in a meridional flow direction m between the leading edge line LE and a point at half a profile depth of the blade tip centrally between leading edge line LE and a trailing edge line TE.

18. The fluid flow machine of claim 1, wherein a plane u-n is established by a circumferential direction u and a normal direction n and the offtake opening of the at least one reversing duct is formed by a shallow ram inlet, with an inclination angle β of a projection of the centerline in the plane u-n against the main flow path confinement being less than 25°.

19. The fluid flow machine of claim 1, wherein offtake openings of adjacent reversing ducts directly adjoin each other in at least one point.

20. The fluid flow machine of claim 1, wherein the supply opening of the at least one reversing duct is provided in a groove extending downstream to behind the leading edge line.

21. The fluid flow machine of claim 1, and further comprising a two-part abradable coating, of which one part is arranged upstream and one part downstream of an offtake zone of the reversing ducts provided in the area of the running gap of the blade row, and that the blade tips at the running gap have one shallow recess each in an area not covered by the abradable coating.

22. The fluid flow machine of claim 1, and further comprising a two-part abradable coating, of which one part is arranged upstream and one part downstream of an offtake zone of the reversing ducts, is provided in the area of the running gap of the blade row, and that the blade tips at the running gap have two short, shallow recesses each arranged in an area between an offtake zone and a respective part of the abradable coating.

23. The fluid flow machine of claim 1, and further comprising a shortened abradable coating provided downstream of an offtake zone of the reversing ducts in the area of the running gap of the blade row, with a number of grooves containing supply openings being located in the main flow path confinement upstream of the offtake zone, and that the blade tips at the running gap have a shallow recess extending to the leading edge.

24. The fluid flow machine of claim 1, wherein reversing ducts having at least one of different shape, position and extension are provided along a circumference of the main flow path confinement.

25. A fluid flow machine comprises:

a hub;

a casing;

a main flow path confined by the hub and the casing;

at least one row of blades arranged in the main flow path;

a gap provided on the at least one row of blades between blade tips and a main flow path confinement, with the blade tips and the main flow path confinement performing a rotary movement relative to each other;

at least one reversing duct provided in an area of leading edges of the blades in the main flow path confinement at a discrete circumferential position, with:

a) the at least one reversing duct having and connecting an offtake opening to a supply opening, both arranged on the main flow path confinement, b) fluid flowing from the main flow path via the offtake opening into the at least one reversing duct, a centroid CGD of the offtake opening being situated downstream of the leading edges of the blade tips, c) fluid flowing from the at least one reversing duct via the supply opening into the main flow path, a centroid CGU of the supply opening being situated upstream of the leading edges of the blade tips, d) a course of the at least one reversing duct being spatially compact, such that fluid is routed upstream near the main flow path against a main flow direction and rerouted exclusively by flow reversal into the main flow path at a shallow angle, e) the at least one reversing duct having a centerline being defined as a connection of all centroids of cross-sections of the at least one reversing duct, that due to its three-dimensional shape, does not extend completely in one plane;

wherein at least one tenth of a length of a confinement edge of the offtake opening is oriented essentially in a direction of a blade profile chord, so that an angle between an inclination of a tangent to the offtake opening (angle $\epsilon$) and an inclination of the blade profile chord (angle $\lambda$) is less than 15°.

26. A fluid flow machine comprises:

a hub;

a casing;

a main flow path confined by the hub and the casing;

at least one row of blades arranged in the main flow path;

a gap provided on the at least one row of blades between blade tips and a main flow path confinement, with the blade tips and the main flow path confinement performing a rotary movement relative to each other;

at least one reversing duct provided in an area of leading edges of the blades in the main flow path confinement at a discrete circumferential position, with:

a) the at least one reversing duct having and connecting an offtake opening to a supply opening, both arranged on the main flow path confinement, b) fluid flowing from the main flow path via the offtake opening into the at least one reversing duct, a centroid CGD of the offtake opening being situated downstream of the leading edges of the blade tips, c) fluid flowing from the at least one reversing duct via the supply opening into the main flow path, a centroid CGU of the supply opening being situated upstream of the leading edges of the blade tips, d) a course of the at least one reversing duct being spatially compact, such that fluid is routed upstream near the main flow path against a main flow direction and rerouted exclusively by flow reversal into the main flow path at a shallow angle, e) the at least one reversing duct having a centerline being defined as a connection of all centroids of cross-sections of the at least one reversing duct, that due to its three-dimensional shape, does not extend completely in one plane;

wherein, when viewing in a plane established by a circumferential direction u and a normal direction n, the centerline of the at least one reversal duct projected to this plane has a crossing such that the centerline obliquely departs from the main flow path confinement and then arcs in an opposite direction back to the main flow path confinement, thus taking a loop-type course with a crossing point outside of the main flow path.

27. A fluid flow machine comprises:

a hub;

a casing;

a main flow path confined by the hub and the casing;

at least one row of blades arranged in the main flow path;

a gap provided on the at least one row of blades between blade tips and a main flow path confinement, with the blade tips and the main flow path confinement performing a rotary movement relative to each other;

at least one reversing duct provided in an area of leading edges of the blades in the main flow path confinement at a discrete circumferential position, with:

a) the at least one reversing duct having and connecting an offtake opening to a supply opening, both arranged on the main flow path confinement, b) fluid flowing from the main flow path via the offtake opening into the at least one reversing duct, a centroid CGD of the offtake opening being situated downstream of the leading edges of the blade tips, c) fluid flowing from the at least one reversing duct via the supply opening into the main flow path, a centroid CGU of the supply opening being situated upstream of the leading edges of the blade tips, d) a course of the at least one reversing duct being spatially compact, such that fluid is routed upstream near the main flow path against a main flow direction and rerouted exclusively by flow reversal into the main flow path at a shallow angle, e) the at least one reversing duct having a centerline being defined as a connection of all centroids of cross-sections of the at least one reversing duct, that due to its three-dimensional shape, does not extend completely in one plane;

wherein the centroid CGU of the supply opening of the at least one reversing duct, with reference to its circumferential position in a circumferential direction u, is disposed between centroids CGD of offtake openings of a next two adjacent reversing ducts each, thus providing for an overlap of adjacent reversing ducts when viewing in a plane established by the circumferential direction u and a normal direction n.

28. A fluid flow machine comprises:

a hub;

a casing;

a main flow path confined by the hub and the casing;

at least one row of blades arranged in the main flow path;

a gap provided on the at least one row of blades between blade tips and a main flow path confinement, with the blade tips and the main flow path confinement performing a rotary movement relative to each other;

at least one reversing duct provided in an area of leading edges of the blades in the main flow path confinement at a discrete circumferential position, with:

a) the at least one reversing duct having and connecting an offtake opening to a supply opening, both arranged on the main flow path confinement, b) fluid flowing from the main flow path via the offtake opening into the at least one reversing duct, a centroid CGD of the offtake opening being situated downstream of the leading edges of the blade tips, c) fluid flowing from the at least one reversing duct via the supply opening into the main flow path, a centroid CGU of the supply opening being situated upstream of the leading edges of the blade tips, d) a course of the at least one reversing duct being spatially compact, such that fluid is routed upstream near the main flow path against a main flow direction and rerouted exclusively by flow reversal into the main flow path at a shallow angle, e) the at least one reversing duct having a centerline being defined as a connection of all centroids of cross-sections of the at least one reversing duct, that due to its three-dimensional shape, does not extend completely in one plane;

and further comprising a shortened abradable coating provided downstream of an offtake zone of the reversing ducts in the area of the running gap of the blade row, with a number of grooves containing supply openings being located in the main flow path confinement upstream of the offtake zone, and that the blade tips at the running gap have a shallow recess extending to the leading edge.

29. A fluid flow machine comprises:

a hub;

a casing;

a main flow path confined by the hub and the casing;

at least one row of blades arranged in the main flow path;

a gap provided on the at least one row of blades between blade tips and a main flow path confinement, with the blade tips and the main flow path confinement performing a rotary movement relative to each other;

at least one reversing duct provided in an area of leading edges of the blades in the main flow path confinement at a discrete circumferential position, with:

a) the at least one reversing duct having and connecting an offtake opening to a supply opening, both arranged on the main flow path confinement, b) fluid flowing from the main flow path via the offtake opening into the at least one reversing duct, a centroid CGD of the offtake opening being situated downstream of the leading edges of the blade tips, c) fluid flowing from the at least one reversing duct via the supply opening into the main flow path, a centroid CGU of the supply opening being situated upstream of the leading edges of the blade tips, d) a course of the at least one reversing duct being spatially compact, such that fluid is routed upstream near the main flow path against a main flow direction and rerouted exclusively by flow reversal into the main flow path at a shallow angle, e) the at least one reversing duct having a centerline being defined as a connection of all centroids of cross-sections of the at least one reversing duct, that due to its three-dimensional shape, does not extend completely in one plane;

wherein reversing ducts having at least one of different shape, position and extension are provided along a circumference of the main flow path confinement.

* * * * *